US007324007B2

(12) United States Patent
Sunderman et al.

(10) Patent No.: US 7,324,007 B2
(45) Date of Patent: Jan. 29, 2008

(54) INSTRUMENTED ROCK BOLT, DATA LOGGER AND USER INTERFACE SYSTEM

(75) Inventors: Carl B. Sunderman, Spokane, WA (US); Jeffrey Craig Johnson, Medical Lake, WA (US); Steve P. Signer, Spokane, WA (US)

(73) Assignee: The United States of America as represented by the Secretary of the Department of Health and Human Services, Centers for Disease Control and Prevention, Washington, DC (US)

( * ) Notice: Subject to any disclaimer, the term of this patent is extended or adjusted under 35 U.S.C. 154(b) by 194 days.

(21) Appl. No.: 10/499,299

(22) PCT Filed: Dec. 27, 2002

(86) PCT No.: PCT/US02/41590

§ 371 (c)(1),
(2), (4) Date: Jun. 17, 2004

(87) PCT Pub. No.: WO03/069122

PCT Pub. Date: Aug. 21, 2003

(65) Prior Publication Data

US 2005/0231377 A1 Oct. 20, 2005

Related U.S. Application Data

(60) Provisional application No. 60/344,961, filed on Dec. 31, 2001.

(51) Int. Cl.
*G08B 21/00* (2006.01)

(52) U.S. Cl. ..... 340/665; 340/539.1; 73/787

(58) Field of Classification Search ..... 340/665, 340/690, 561, 539.1; 405/259.1; 73/787, 73/784, 152.59, 597
See application file for complete search history.

(56) References Cited

U.S. PATENT DOCUMENTS 2,848,648 A 8/1958 Wolcott et al. ..... 315/26

(Continued)

FOREIGN PATENT DOCUMENTS

CH 645 979 10/1984

(Continued)

OTHER PUBLICATIONS

Davis, "Split-set Rock Bolt Analysis," *Int. J. Rock Mech. Min. Sci. and Geomech. Abstr.*, vol. 16, pp. 1-10, 1979.

(Continued)

*Primary Examiner*—Phung T. Nguyen
(74) *Attorney, Agent, or Firm*—Klarquist Sparkman, LLP

(57) ABSTRACT

A rock bolt includes a hollow body and a gap along a length of the hollow body. At least one strain gauge is affixed to an inner surface of the rock bolt and is accessible from the gap. The rock bolt may include a data logger within the hollow body and coupled to receive signals from one or more strain gauges, and to record these signals in a memory. The data logger may comprise a data port adapted to be accessible from the outside of a bore hole into which the rock bolt is inserted. The data logger also may include at least one of a visual and auditory alarm. A graphic user interface software program can be used to download data from the data logger and set certain operating parameters of the data logger.

38 Claims, 24 Drawing Sheets

U.S. PATENT DOCUMENTS

| | | | | | |
|---|---|---|---|---|---|
| 3,894,427 | A | | 7/1975 | Schuermann et al. | 73/88 E |
| 3,987,667 | A | | 10/1976 | Rasmussen et al. | 73/88 E |
| 4,012,913 | A | | 3/1977 | Scott | 61/45 B |
| 4,091,990 | A | | 5/1978 | Rasmussen et al. | 234/115 |
| 4,114,428 | A | | 9/1978 | Popenoe | 73/88 F |
| 4,136,556 | A | * | 1/1979 | Graham | 340/690 |
| RE30,256 | E | | 4/1980 | Scott | 405/259 |
| 4,318,302 | A | * | 3/1982 | Choi | 73/761 |
| 4,409,824 | A | | 10/1983 | Salama et al. | 73/151 |
| 4,410,296 | A | * | 10/1983 | Unrug | 405/302.1 |
| 4,426,642 | A | * | 1/1984 | Poffenbarger | 340/690 |
| 4,581,712 | A | * | 4/1986 | Perry et al. | 702/138 |
| 4,601,207 | A | | 7/1986 | Steblay | 73/597 |
| 4,803,888 | A | | 2/1989 | Choquet | 73/862.39 |
| 5,161,857 | A | * | 11/1992 | Mayercheck et al. | 299/30 |
| 5,185,595 | A | * | 2/1993 | Friesen | 340/690 |
| 5,343,963 | A | | 9/1994 | Bouldin et al. | 175/27 |
| 5,363,562 | A | | 11/1994 | Schmidt | 33/567.1 |
| 5,392,027 | A | | 2/1995 | Brunot et al. | 340/561 |
| 5,392,654 | A | | 2/1995 | Boyle | 73/761 |
| 5,502,656 | A | * | 3/1996 | Fulcher et al. | 702/187 |
| 5,542,788 | A | | 8/1996 | Stankus et al. | 405/288 |
| 5,598,738 | A | | 2/1997 | Buescher, Jr. et al. | 73/761 |
| 5,774,419 | A | | 6/1998 | Uhl et al. | 367/38 |
| 5,803,671 | A | | 9/1998 | Gray | 405/259.1 |
| 5,804,737 | A | | 9/1998 | Johnson, III et al. | 73/761 |
| 5,811,694 | A | | 9/1998 | Kamentser et al. | 73/862.045 |
| RE35,918 | E | | 10/1998 | Anderson et al. | 73/862.49 |
| 5,922,967 | A | | 7/1999 | Motoyama | 73/794 |
| 5,929,341 | A | | 7/1999 | Bawden et al. | 73/784 |
| 6,038,933 | A | | 3/2000 | Meyer | 73/862.045 |
| 6,134,974 | A | | 10/2000 | Grover | 73/862.451 |
| 6,146,055 | A | | 11/2000 | White | 405/259.4 |
| 6,311,564 | B1 | | 11/2001 | Martin et al. | 73/787 |
| 6,928,881 | B2 | * | 8/2005 | Brennan | 73/766 |

FOREIGN PATENT DOCUMENTS

| | | |
|---|---|---|
| DE | 34 02 709 | 8/1985 |
| DE | 3636322 | 5/1988 |
| EP | 0 344 926 | 12/1989 |
| EP | 0 867 687 | 9/1998 |
| WO | WO 96 39610 | 12/1996 |
| WO | WO 99 56003 | 11/1999 |
| WO | WO 00 42287 | 7/2000 |

OTHER PUBLICATIONS

Haas et al., "An Investigation of the Interaction of Rock and Types of Rock Bolts for Selected Loading Conditions," Third Annual Report, USBM Contract Report (H0122110), pp. 3-64 to 3-67 and 4-1 to 4-9, Jun. 15, 1976.

Ingersoll-Rand product catalog, Series SS-33, SS-39, and SS-46 Split Set® stabilizers, 3 pages (date unknown).

"Instrumented Bolt Measures Bending Moments Within Itself," *Tech Briefs, Engineering Solutions for Design & Manufacturing*, vol. 26, No. 1, pp. 27-28, Jan. 2002.

Tamames, B. Celada, "Fourteenth Years of Experience on Rock Bolting in Spain,"*Rock Bolting, Theory and Application in Mining and Underground Construction, Proceedings of the International Symposium on Rock Bolting*, pp. 295-311, Aug. 28-Sep. 2, 1983.

"Development of Instrumentation to Monitor the Radial Deformation of the Medium Around an Underground Opening," U.S. Bureau of Mines, Annual Technical Report, Mar. 9, 1972.

"Development of Instrumentation to Monitor the Radial Deformation of the Medium Around an Underground Opening," U.S. Bureau of Mines, Semiannual Technical Report, Sep. 29, 1972.

Signer, Stephen, "Load Behavior of Grouted Bolts in Sedimentary Rock," NIOSH Information Circular 2000, Proceedings: New Technology For Coal Miner Roof Support, pp. 73-80 (2000).

Signer et al., "A Method for the Selection of Rock Support Based on Bolt Loading Measurements," International Symposium on Rock Support, 12 pages, Jun. 22-25, 1997.

Signer et al., "Effects of Bolt Spacing, Bolt Length, and Roof Span on Bolt Loading in a Trona Mine," 20th International Conference on Ground Control in Mining, 7 pages, Aug. 7-9, 2001.

Hoek et al., *Support of Underground Excavations in Hard Rock*, pp. 152-164, 1998.

Jennmar Corp. website, "Friction-Lok® Stabilizer System," www.jennmar.com/products/productsfrictionlok.html, 2 pages (publication date unknown).

Steeledale SCS website, "Friction Rock Anchors," www.steeledalescs.co.za/scs5.html, 2 pages (publication date unknown).

H.R.C. Bolts PTY LTD website, "The Hardi Friction Rock Stabilizer," www.home.aone.net.au/pcr/hardi/homepage.html, 2 pages (publication date unknown).

American Remote Vision Corp. website, "A Perfect Torque Value Still Gives You A Large Tension Error!," www.arvc.com, 5 pages (publication date unknown).

Tokyo Sokki Kenkyujo Co., Ltd. website, www.tokyosokki.co.jp/e/product/instrument/special.html, 1 page (publication date unknown).

StrainDAQ website, www.straindaq.com, 1 page (publication date unknown).

Roctest Telemac website, "Anchor Load Cell," www.roctest.com/roctelemac/product/product/anclo.html, 1 page (publication date unknown).

European Search Report for corresponding European Application No. 02799328.6, Nov. 2005.

English translation of Swiss Patent No. CH 645,979, Oct. 1984.

Schmidt-Hattenberger et al., "Bragg Grating Extensometer Rods (BGX) for Geotechnical Strain Measurements," *SPIE Proceedings*, vol. 3483, 1998 (abstract only), 1998.

* cited by examiner

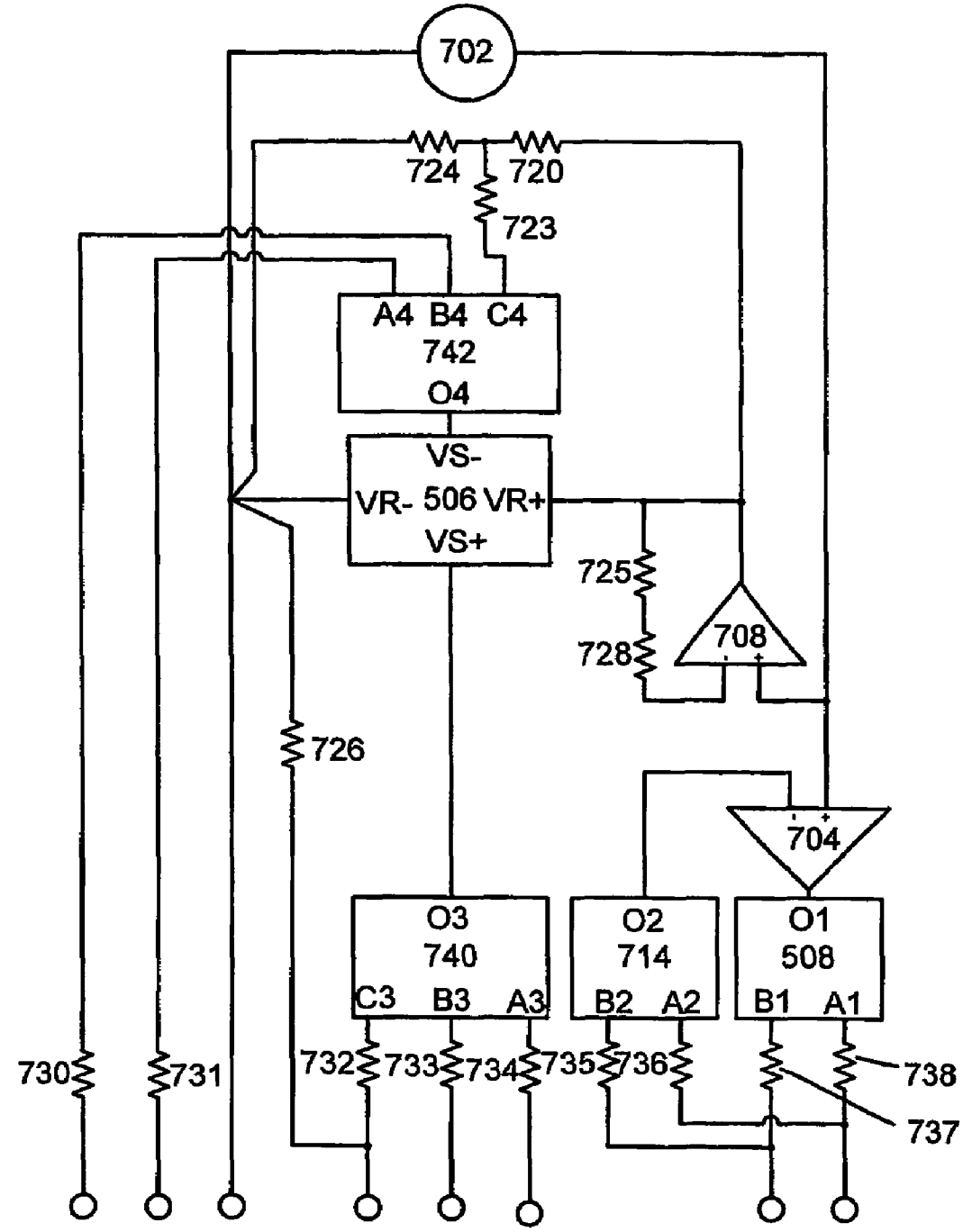
FIG. 12
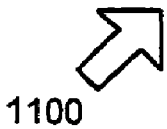

1704

INSTRUMENTED ROCK BOLT, DATA LOGGER AND USER INTERFACE SYSTEM

This is a national stage under 35 U.S.C. §371 of International Application No. PCT/US02/41590, filed Dec. 27, 2002, which claims the benefit of U.S. Provisional Patent Application No. 60/344,961, filed Dec. 31, 2001.

FIELD

The present invention relates generally to rock bolts, and more particularly to strain detection and data logging in rock bolts and other mining fasteners.

BACKGROUND

One challenge facing the underground mining industry is the instability of rock mass comprising the roof and walls of mines. Rock mass may shift and/or loosen over time, increasing the likelihood of rock falls. To lessen the likelihood and impact of rock falls, rock bolts may be driven into bore holes in the rock mass. Rock bolts typically comprises rigid substances, such as metal or hard plastic and may vary in length—lengths of eighteen inches to over twenty feet are common. Rock bolts are typically formed as cylinders and may have a solid or hollow core.

In addition to providing stability to the rock mass, rock bolts facilitate the detection of potentially hazardous stresses and strains in the rock mass. Strain gauges affixed to the rock bolts provide a measure of the strains and hence the stresses which the rock bolt is subjected to. However, attempts to fit rock bolts with strain gauges have been problematic. Affixing strain gauges to the outside surface of rock bolts is largely impractical, due to the tendency of strain gauges to be damaged or dislocated from the rock bolt when the rock bolt is inserted into the bore hole. Fitting strain gauges within closed hollow-core rock bolts also presents a challenge, due to the inaccessibility of the interior core of such bolts.

Strain gauges must typically be energized via conductors in order to produce signals under strain. Energizing strain gauges affixed to rock bolts that are inserted into bore holes, and retrieving signals from these gauges, has proven problematic. When the gauge's conductors are exposed outside of the rock bolt, they may be damaged and degraded by the harsh conditions present in mines.

SUMMARY

In one aspect, a rock bolt includes a hollow body and a gap along a length of the hollow body. At least one strain gauge is affixed to an inner surface of the rock bolt and is accessible from the gap. The rock bolt may include a data logger within the hollow body, which is coupled to receive signals from one or more strain gauges, and to record these signals in memory. The data logger may include a data port adapted to be accessible from the outside of a bore hole into which the rock bolt is inserted. At least one of a visual and auditory alarm may be included, the alarm coupled to at least one of a threshold detector, a rate threshold detector, and a higher order rate threshold detector.

In another aspect, a rock bolt includes a body and a notch along a length of the body. At least one strain gauge is recessed and within the notch or within a hollow body of the bolt. A data logger may be recessed within the notch, and coupled to receive signals from the strain gauges and to record the signals in memory. A data port of the data logger may be adapted to be accessible from the outside of a bore hole into which the rock bolt is inserted A visual and/or auditory alarm may be included, the alarm coupled to at least one of a threshold detector, a rate threshold detector, and a higher order rate threshold detector.

A data logger compatible with these aspects of a rock bolt may include a controller, memory, and a primary multiplexer. The primary multiplexer may be coupled to the controller and may select, in response to signals from the controller, one of a plurality of strain gauges to couple to an excitation source. Another multiplexer also may be coupled to the controller and may couple, in response to signals from the controller, the selected strain gauge in a feedback loop through a voltage feedback amplifier to the primary multiplexer, such that a reference excitation voltage to the selected strain gauge is maintained.

According to another aspect, a graphic user interface software program includes one or more graphical user interface elements that allow a user to set certain operating parameters of a data logger being used to sample one or more strain gauges. In particular embodiments, for example, the program includes graphical user interface elements for selecting the strain gauges to be sampled by the data logger, setting the scan rate of the data logger, and setting the excitation time of the strain gauges. In particular embodiments, the program also is operable to automatically establish a communication link between the data logger and a computer, and download strain data from the data logger to the computer, where the data can be displayed in graphical form.

In another aspect, a graphic user interface program displays strain data, such as data recorded and downloaded from a data logger, in a format that allows for identification of unusual trends in measured strains of a rock mass. In a disclosed embodiment, the program displays a plurality of time-varying bar graphs, each of which represents the strain measured by one of a plurality of strain gauges. The time-varying display provides a visual indication of the rate of change of strain, which makes it possible to better detect instabilities in the rock mass that can lead to a cave in.

Further, in particular embodiments, if the strain measured by any of the strain gauges exceeds a first predetermined threshold, the corresponding bar graph changes from an initial color to a second color to indicate the possible onset of a dangerous condition. If the strain measured by any of the strain gauges exceeds a second predetermined threshold, the corresponding bar graph changes from the second color to a third color to indicate that the strain has exceeded an acceptable level and a possible dangerous condition exists.

The foregoing and other features and advantages of the invention will become more apparent from the following detailed description of several embodiments, which proceeds with reference to the accompanying figures.

BRIEF DESCRIPTION OF THE DRAWINGS

FIG. 12 is a detailed block diagram of an embodiment a data logger similar to the embodiment shown in FIG. 11, but incorporating multiple current-limiting resistors.

DETAILED DESCRIPTION

In the following description, references to "one embodiment" and "an embodiment" do not necessarily refer to the same embodiment, although they may.

Rock Bolt with Strain Detection

Figure 1:
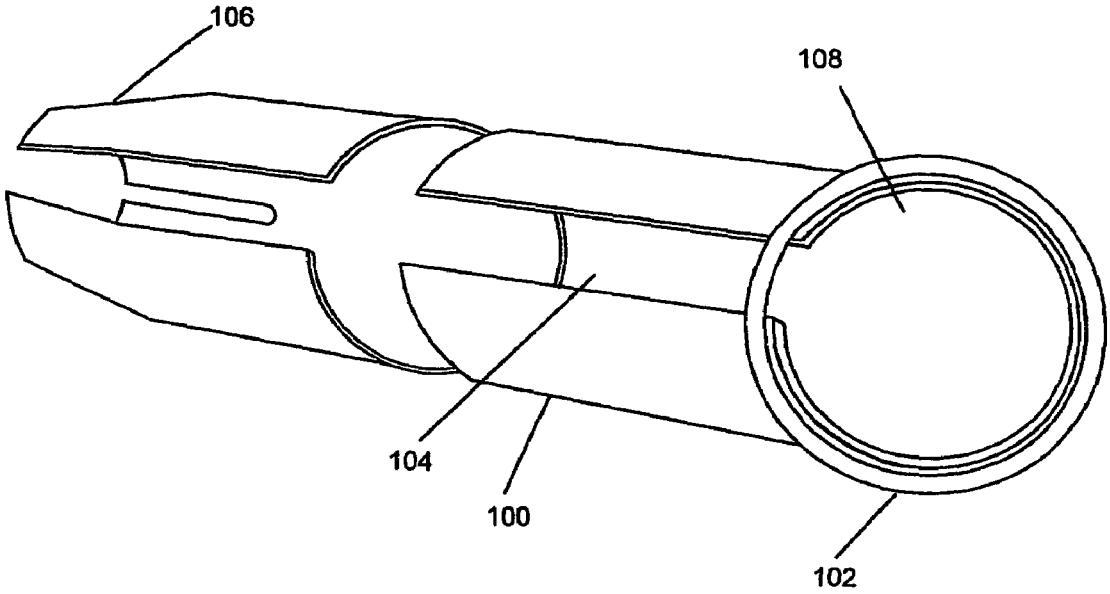
FIG. 1 is a perspective view of a rock bolt embodiment.

FIG. 1 shows an embodiment 100 of a rock bolt. Only the ends of the rock bolt 100 are shown; a middle section has been cut away so that the illustration may fit the page. The rock bolt 100 comprises a gap 104 which runs the length of the bolt. Typical lengths for the bolt are from eighteen inches to over twenty feet. Materials which may be used to construct the bolt include steel and other alloys, and plastics and polymers. A distal end 106 of the bolt is tapered and is inserted into a bore hole in a mining wall, roof, or even floor. A proximal end 108 comprises a ring flange 102. The bolt 100 may be pressed into the bore hole, typically engaging friction from the surrounding rock in the process, until the flange 102 is flush or nearly flush with the wall's surface. Stresses and strains in the rock may then be transferred to some extent to the body of the bolt A plug (not shown) may be fitted into the proximal end 108, and a plate and cap may also be fitted over the proximal end 108, in well known manners.

Figure 2:
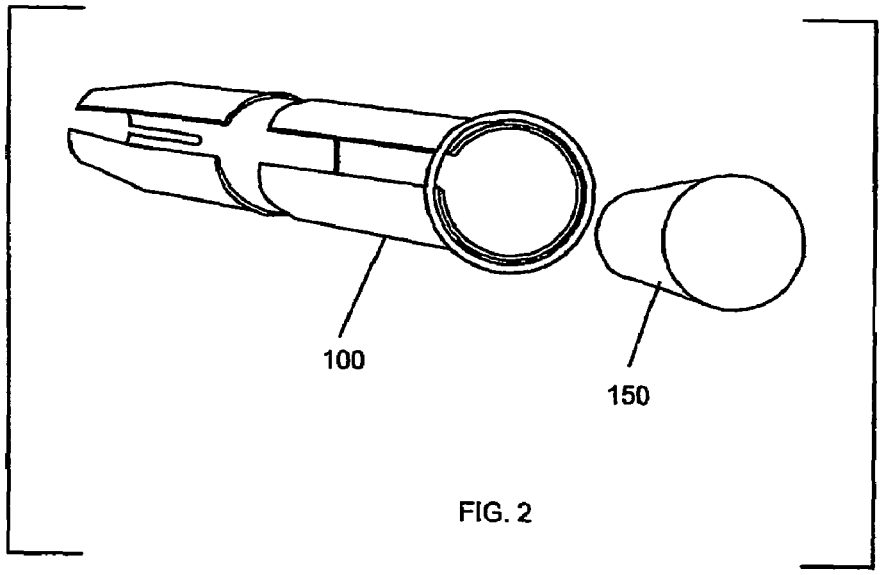
FIG. 2 is an exploded perspective view of a rock bolt embodiment and a plug.

With reference to FIG. 2, a plug 150 may be inserted to seal the proximal end 108 of the rock bolt 100.

Figure 3:
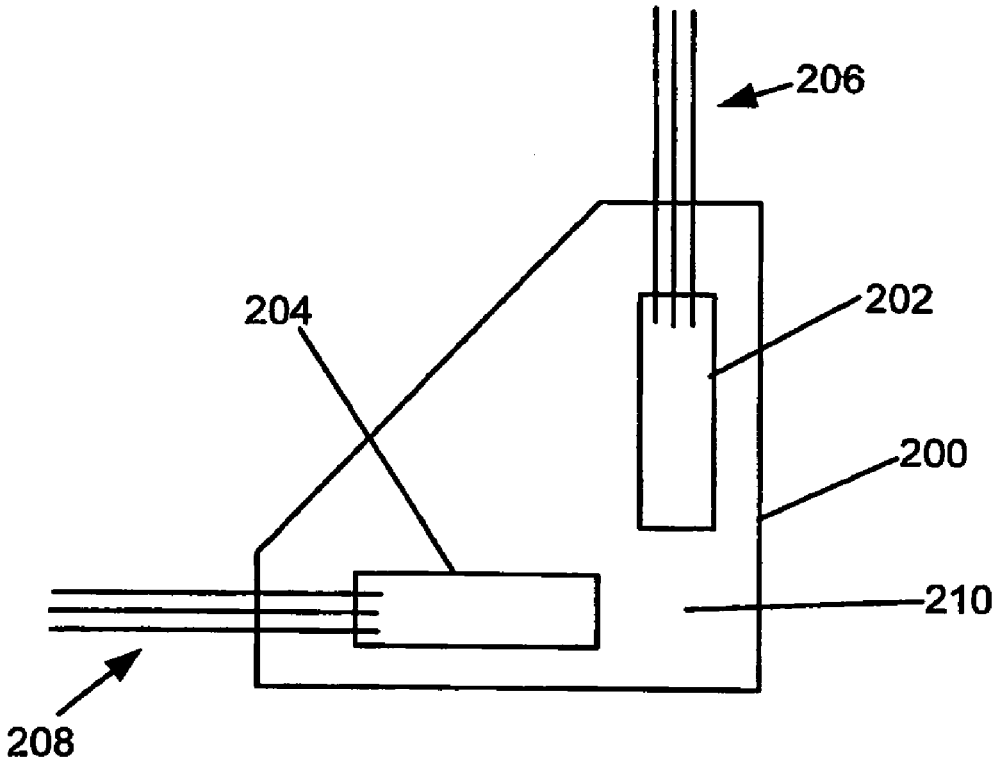
FIG. 3 is an illustration of a strain gauge embodiment that may be used in conjunction with the rock bolt of FIG. 1.

Stresses and strains which are transferred to the body of the rock bolt 100 may be detected using one or more strain gauges. FIG. 3 shows an embodiment 200 of a strain gauge which may be operated for this purpose. A rock bolt equipped with one or more strain gauges may be termed an "instrumented rock bolt." Numerous types of gauges, including rosette gauges, may also be employed in various patterns (delta, rectangular, ¼ bridge, ½ bridge, full bridge, etc.). The strain gauge 200 comprises strain sensors 202, 204 affixed to a backing 210. The sensors 202, 204 may comprise various technologies, including platinum-tungsten grids backed with laminated polyimide film or cast fiberglass-reinforced polyimide. Other types of gauges may comprise constantan-alloy or Karma-alloy elements, to name just a few of the possibilities.

The backing 210 may comprise various materials, depending to some extent upon the object to which the backing is to be affixed. In general, the backing material should have a coefficient of thermal expansion that matches the coefficient of thermal expansion of the object to which it is affixed. For example, steel is one backing material that may be suitable for use with steel rock bolts. When the backing 210 is steel, the strain gauge may be affixed to a steel rock bolt by spot welding or gluing the backing 210 to an interior surface of the rock bolt body. As strains and stresses are applied to the rock bolt to which the strain gauge is affixed, these strains and stresses are detected by the strain sensors 202, 204. The strain sensors 202, 204 generate signals in response to the stresses and strains on the rock bolt, and these signals are made available on conductors 206, 208. Typically, the generated signals are electrical, although the generation of optical or wireless signals is also a possibility.

Figure 4:
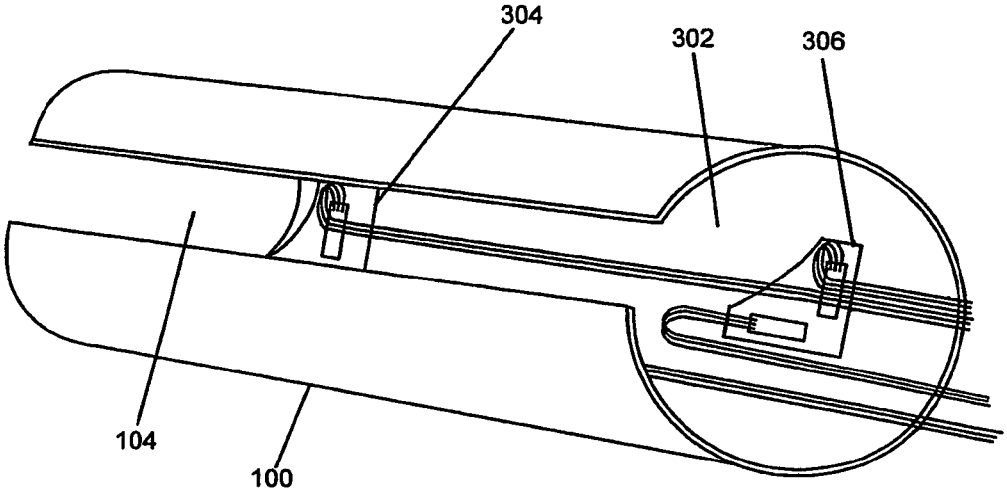
FIG. 4 is a perspective view of one embodiment of an instrumented rock bolt with multiple strain gauges positioned along an inner surface of a rock bolt embodiment.

FIG. 4 shows one embodiment of strain gauges 304, 306 affixed to an interior surface 302 of a section 100 of a rock bolt. In the illustrated embodiment, the surface 302 to which the strain gauges are affixed is opposite the gap 104 to facilitate access to the interior surface 302 with a spot welder or other means of attachment Although less desirable, strain gauges 304, 306 can be positioned at other locations on surface 302 not directly opposite the gap 104.

In particular embodiments, strain gauges are affixed at regular intervals along the surface 302 opposite the gap 104. For example, strain gauges may be affixed every two feet, every foot, and every six inches. An advantage of closer spacing is more comprehensive strain detection; disadvantages are greater complexity and higher cost.

Data Logger for Rock Bolt

Figure 5:
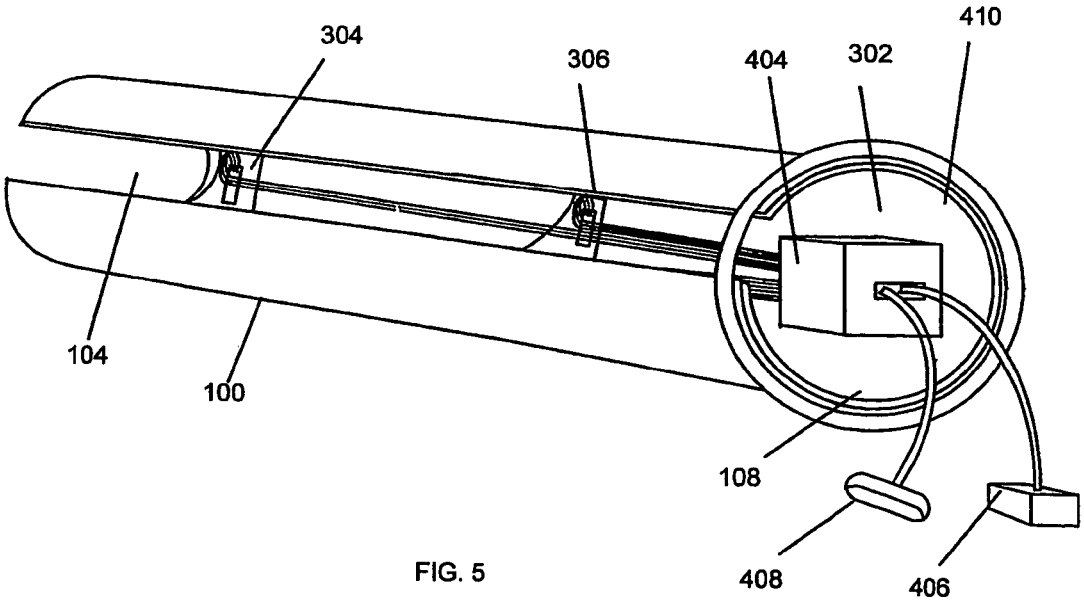
FIG. 5 is a perspective view of an embodiment of a data logger positioned on an inner surface of an instrumented rock bolt embodiment.

FIG. 5 shows strain gauges 304, 306 coupled to a data logger 404, which may be placed within a hollow core rock bolt. The data logger 404 may be fastened within the hollow core, or may be placed unfastened inside the core. The data logger 404 records signals propagated by the conductors in response to stresses and strains detected by the gauges 304, 306. The data logger 404 may comprise logic to process the received signals and to determine whether the stresses and strains on the rock bolt 100 are outside of acceptable limits. When the stresses and strains on the rock bolt 100 are outside of acceptable limits, the data logger 404 may generate an alarm signal. This signal may be received by an alerting device 406, such as a visible or audible alarm, to warn of unusual or dangerous stresses in the surrounding rock.

The alert device 406 may be mounted internally or externally to the rock bolt bore hole. For example, the alert device 406 could be mounted inside the hollow bore of the rock bolt 100, or on a plate inside a cap fitted over the proximal end 410 of the rock bolt 100. The alert device 406 could also be mounted on the wall next to the bore hole into which the rock bolt 100 is inserted. In one embodiment, a light-transparent plug may inserted into the proximal end 410 of the rock bolt 100, and the alert device 406 may be an LED or other light source placed within the hollow core and visible through the plug.

A data port 408, such as a serial port or parallel port, may also be coupled to the data logger 404. The data port 408 may be accessed in order to read strain data stored in a memory of the data logger 404. In another embodiment, the alert device 406 may receive the alarm signal from the data port 408.

When a proximal end 410 of the rock bolt is plugged, the strain gauges 304, 306, and the data logger 404, may be enclosed within the interior of the rock bolt 100. The data port 408 may also be enclosed, or may protrude or be otherwise accessible on or through the plug.

The gap 104 provides access to the interior of the rock bolt 100, along its entire length, so that strain gauges may be positioned along the entire length of the bolt 100, not just near the ends. The body of the rock bolt 100 may protect the strain gauges and their conductors from wear and tear resulting from the harsh conditions in the bore hole. The data logger 404, placed within the interior of the rock bolt 100, enables the recording of strain data without routing the conductors of the strain gauges external to the rock bolt 100, where they might be subjected to environmental wear and tear. A plug and/or cap on the rock bolt 100 may be removed to access the strain data stored by the data logger 404, or, when the data port 408 is externally accessible, the strain data may be accessed without removing the plug and possibly not removing the cap as well (for example, where the data port 408 is mounted on the cap). The external alert device 406 provides automatic notification of alarming stress and strain conditions without substantial oversight or monitoring by persons operating within the mine.

In another embodiment, the data logger 404 may communicate data stored in its memory via wireless signals to a data receiver located outside of the bore hole. The external alert device 406 may also receive the alert signal via a wireless signal. In one embodiment the wireless signals communicated between the data logger and devices external to the bore hole are radio frequency (RF) signals. In wireless embodiments, any plugs or caps employed may be formed from materials which do not substantially impede wireless signals, such as non-attenuating plastics.

Figure 6:
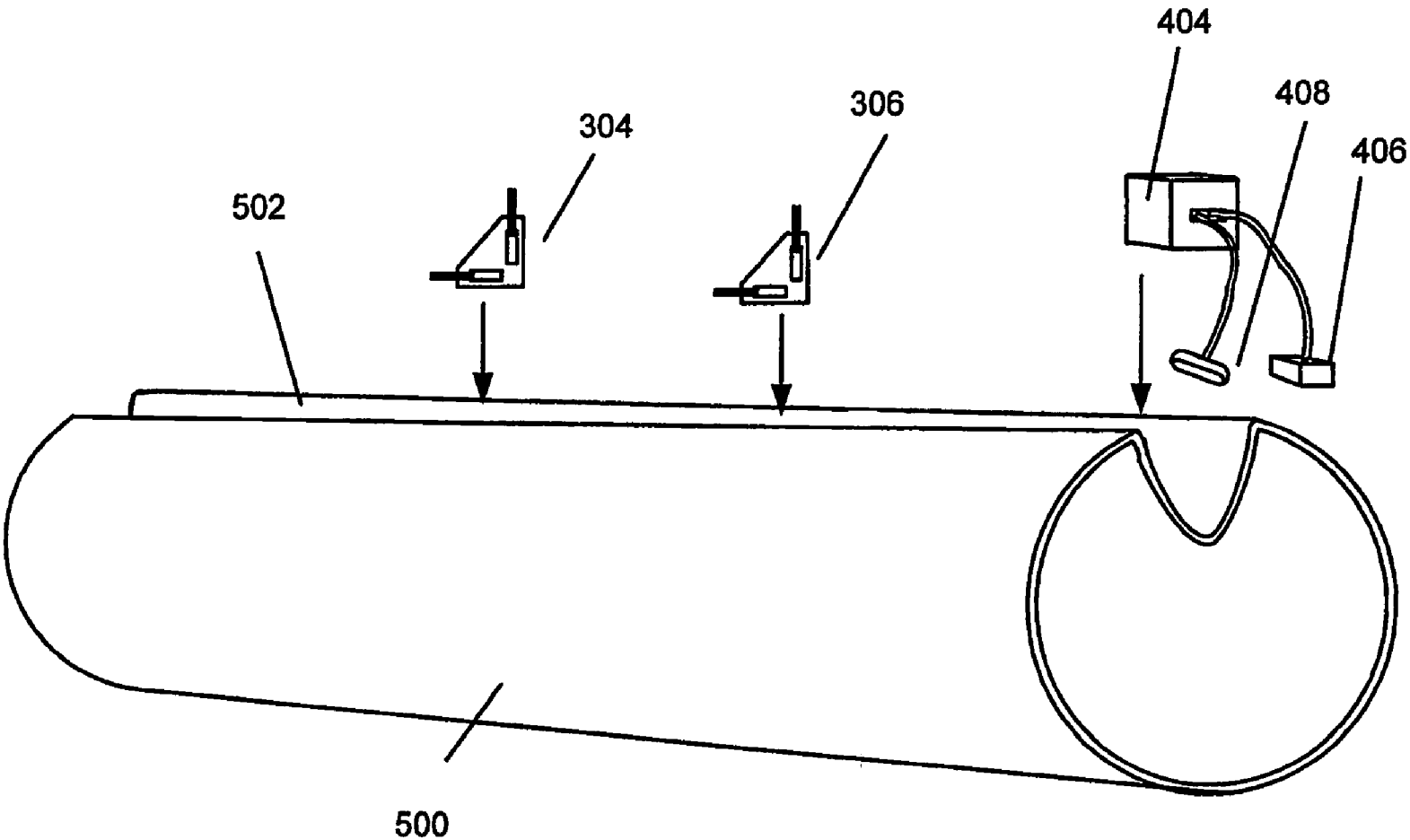
FIG. 6 is a perspective view of another embodiment of an instrumented rock bolt having multiple strain gauges and a data logger.

FIG. 6 shows an embodiment 500 of a rock bolt having a notch 502 on an external surface of the rock bolt In another aspect, strain gauges and a data logger may be positioned along the length of the rock bolt 500, such that the strain gauges, data logger, and conductors of the strain gauges are recessed into the notch. Alternatively, the data logger and/or some strain gauges may be located within the hollow core of the rock bolt 500, and the conductors of the strain gauges may be routed through holes drilled in the surface of the rock bolt 500. When the rock bolt 500 is inserted into a bore hole, the strain gauges, conductors, and data logger are protected by the notch and hollow core from the surrounding rock to some extent.

Figure 6A:
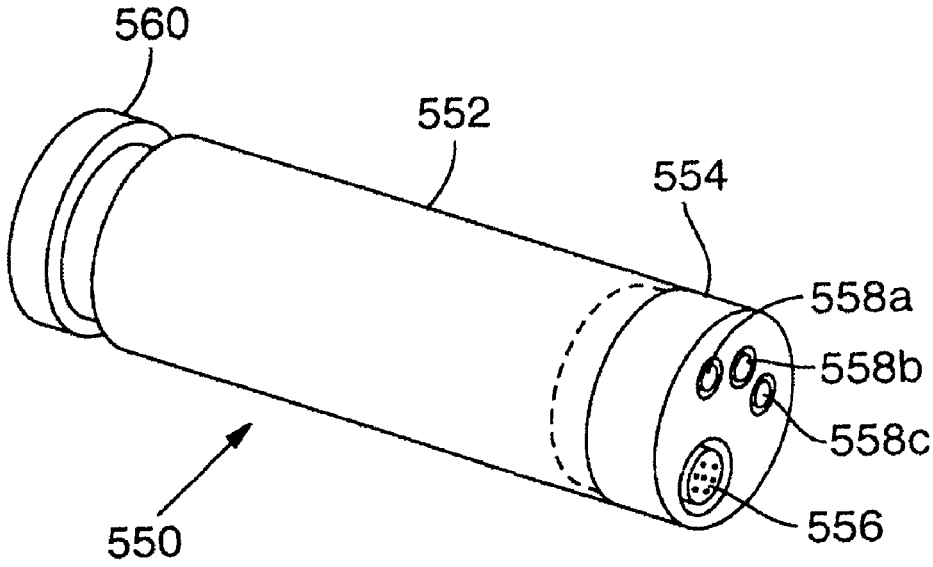
FIG. 6A is a perspective view of another embodiment of a data logger adapted to be received inside a rock bolt.

FIG. 6A shows a data logger indicated generally at 550, according to another embodiment. In an exemplary use, date logger 550 can be used to record signals generated by one or more strain gauges, although it also can be used to record signals generated by other types of resistive sensors, such as potentiometers. Data logger 550 has a generally cylindrical housing 552 dimensioned to be inserted inside the hollow core of a rock bolt (e.g., any of the rock bolts of FIGS. 1, 2, 4, 5, and 6) for in situ strain measurements. A front end portion 554 is partially inserted into the body 552 and is removable therefrom for connecting a battery (not shown) to a battery terminal inside the body 552. The front end portion 554 includes a data port 556 for accessing the data stored in the memory of the data logger, and light-emitting diodes (LEDs) 558*a*, 558*b*, and 558*c*.

In particular embodiments, each LED 558*a*, 558*b*, and 558*c* is operable to emit a different colored light (e.g., a green light for LED 558*a*, a yellow light for LED 558*b*, and a red light for LED 558*c*). In use, LED 558*a* flashes if the strain being measured by the strain gauges is within acceptable limits. LED 558*b* begins to flash if the strain being measured by any of the strain gauges exceeds a first predetermined threshold, and LED 558*c* begins to flash if the strain being measured by any of the strain gauges exceeds a second predetermined threshold.

Data logger 550 in the illustrated configuration also includes a quick disconnect 560 adapted to mate with a common connector for the conductors of the strain gauges. In this manner, the data logger can be quickly and easily connected to and disconnected from the strain gauges.

Figure 7:
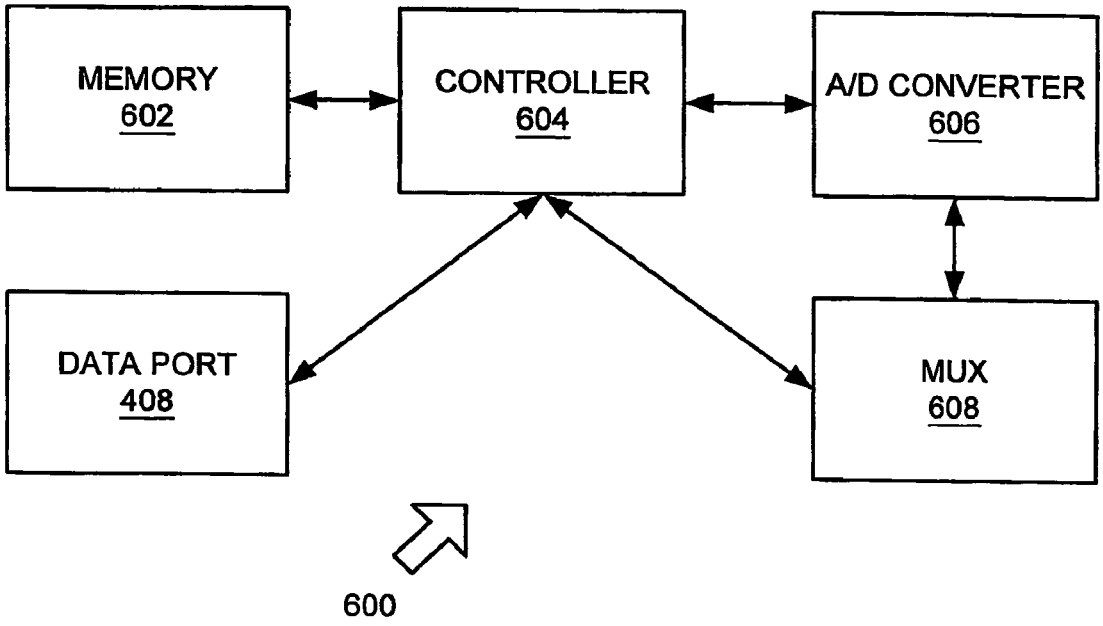
FIG. 7 is a block diagram of an embodiment of a data logger.

FIG. 7 is a block diagram of an embodiment 600 of a data logger. Data logger 600, as well as the other embodiments of data loggers described herein, can be used to store data corresponding to measurements taken by one or more resistive sensors, such as strain gauges, potentiometers, and the like. The data logger 600 comprises a memory 602 to store signals received from one or more resistive sensors (e.g., strain gauges affixed along the length of a rock bolt or other fastening device). The data logger 600 is designed to be small enough and robust enough to operate within a hollow-core rock bolt inserted in a bore hole in a mining wall, although the data logger 600 is not limited to such applications.

A controller 604, such as an embedded micro-controller, may be employed to control the operation of components of the data logger 600, including the sequencing into memory of signals received from multiple sensors. A multiplexer 608 selects a signal from multiple sensors and provides the signal to an analog-to-digital (ADC) converter 606, which converts the signal to a digital format suitable for storage in the memory 602. A serial data port 408 is provided in order to retrieve the signal data stored by the memory 602, and optionally to provide program instructions to the controller 604. One or more conductors of the data port 408 may also provide the alert signal to an alarm. If the data logger is used in conjunction with a rock bolt, such as described above, such an alarm desirably is exposed externally to a bore hole into which the rock bolt is inserted (for example, mounted on or recessed within a cap over the bore hole).

In particular embodiments, a data logger configured to operate within the body of a rock bolt includes a controller, a memory, and a first multiplexer. The first multiplexer is coupled to the controller and selects, in response to signals from the controller, one of a plurality of strain gauges to couple to an excitation source. Second and third multiplexers, discussed more fully in conjunction with FIG. 8, also may be coupled to the controller. The second multiplexer may couple, in response to signals from the controller, the selected strain gauge to an analog-to-digital converter, and the third multiplexer may couple, in response to signals from the controller, the selected strain gauge to the excitation source in a feedback loop with the first multiplexer, such that a reference excitation voltage to the selected strain gauge is maintained.

Exemplary Embodiments of Data Logger Circuitry

Figure 8:
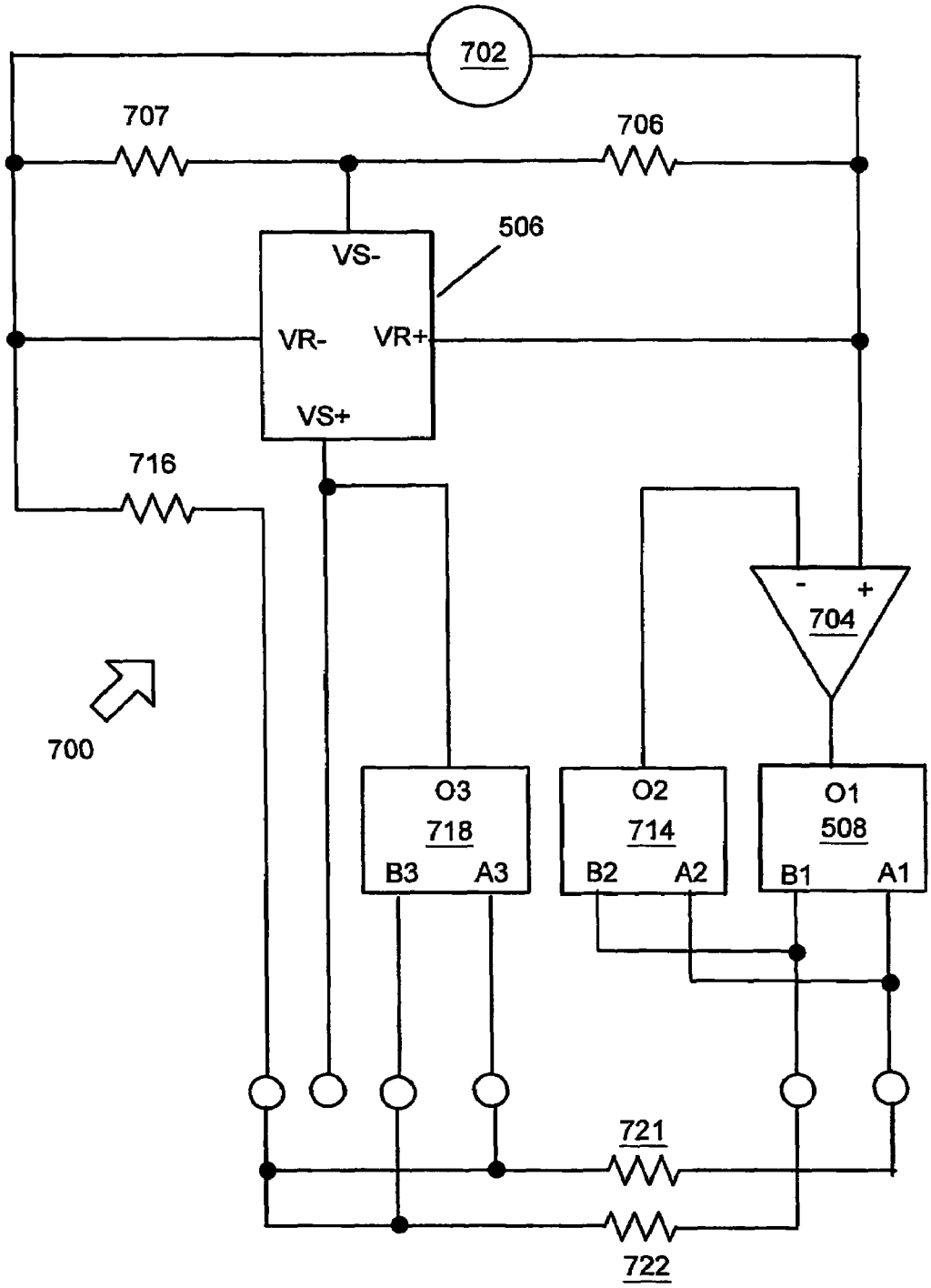
FIG. 8 is a detailed block diagram of an embodiment of a data logger.

FIG. 8 is a detailed block diagram of an embodiment 700 of a data logger, which includes an excitation source, an analog to digital converter (ADC) 506, and multiplexers 508, 714, and 718. The excitation source in the illustrated configuration includes a supply, or voltage source, 702 and an amplifier 704. Supply 702 provides voltage and current to power the components of the data logger. As shown, the ADC 506 is coupled to both sides of the supply at VR+ and VR−. The illustrated ADC 506 is a single channel, differential input ADC. However, other types of ADC's also can be used. In one embodiment, for example, two channels of a single ended, multi-channel ADC are used, with the two signals divided in software.

A voltage divider circuit comprised of resistors 706, 707 provides a reference input voltage at VS−. The input voltage at VS+ is determined by the voltage divider comprising the resistor 716 and the resistance (impedance) provided by a selected strain gauge. The ADC 506 produces a digital output signal having a value proportional to the difference between the voltages at VS− and VS+.

Data logger 700 selects one of two strain gauges for sampling, which are represented by resistors 721, 722 in the illustrated embodiment. When the data logger 700 "samples" a strain gauge, it couples the strain gauge to an excitation source and acquires the signal generated by the strain gauge. The signal may be recorded in the memory of the data logger or communicated to a computer via a data port. In other applications, data logger 700 can be used to log data measured by other forms of resistive sensors, such as potentiometers. In addition, although the illustrated data logger 700 is configured to sample two sensors, this is not a requirement. Thus, the embodiment of FIG. 7, as well as the other embodiments of data loggers described herein, can easily be expanded to accommodate the sampling of any number of sensors.

The signal at the input O1 of the multiplexer 508 is provided by a voltage feedback amplifier (VFA) 704. Under the direction of the controller 604 (FIG. 7), the multiplexer 508 selects the signal at O1 to one of the outputs A1, B1. Simultaneously, the controller causes multiplexers 714, 718 to select a corresponding input A, B to their outputs O. For example, when the controller 604 causes multiplexer 508 to select input O1 to output A1, the controller 604 simultaneously causes multiplexer 714 to select input A2 to output O2 and multiplexer 718 to select input A3 to output O3. One of the strain gauges 721, 722 is thus selected for sampling. When multiplexer 508 output A1 is selected, strain gauge 721 is sampled. When multiplexer 508 output B1 is selected, strain gauge 722 is sampled. A feedback loop is also formed through multiplexer 714 from the output of multiplexer 508 to the inverting input of the VFA 704. This feedback loop maintains at the outputs A1, B1 of the multiplexer 508 the reference voltage as provided to the non-inverting input of VFA 704. The feedback loop compensates for resistive losses that may occur due to the impedance of the multiplexer 508. The voltage at VS+ is thus a measure of the impedance of the selected strain gauge, which in turn is a measure of the strain on the gauge. To sample a number n of strain gauges, n 'force' conductors are connected to multiplexer 508, n 'signal' conductors are connected to multiplexer 718, and n 'return' conductors are connected to the completion resistor 716. By providing both a signal and return conductor for each strain gauge, resistance-temperature effects in the conductors themselves are reduced. Embodiment 700 is similar to embodiment 800 of FIG. 9 but provides for more fault tolerance by providing signal and return conductors from each strain gauge.

Figure 9:
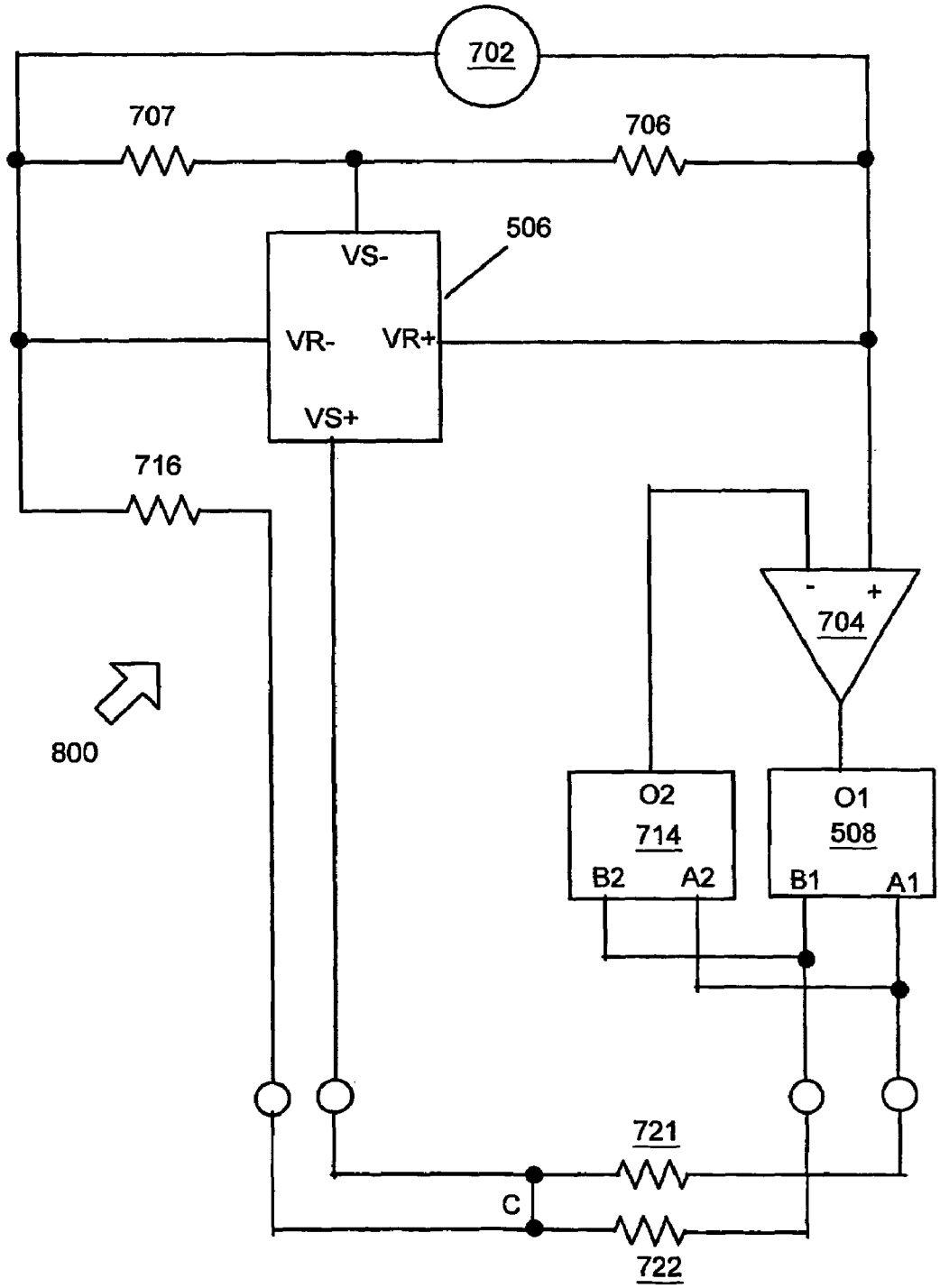
FIG. 9 is a detailed block diagram of another embodiment of a data logger.

With reference to FIG. 9, another embodiment 800 of a data logger may omit multiplexer 718. This embodiment 800 may be employed where the strain gauges 721, 722 are connected together at node C remotely from the data logger. One of the two conductors connected at C carries return current to the completion resistor 716. The other conductor connected at C carries the signal voltage to the input VS+ of the ADC 506. To sample a number n of strain gauges, n conductors are connected to multiplexer 508, one conductor is connected to VS+ and one conductor is connected to the completion resistor 716. Embodiment 800 is similar to embodiment 700 of FIG. 8 but allows for fewer conductors connecting the strain gauges to the data logger.

Figure 10:
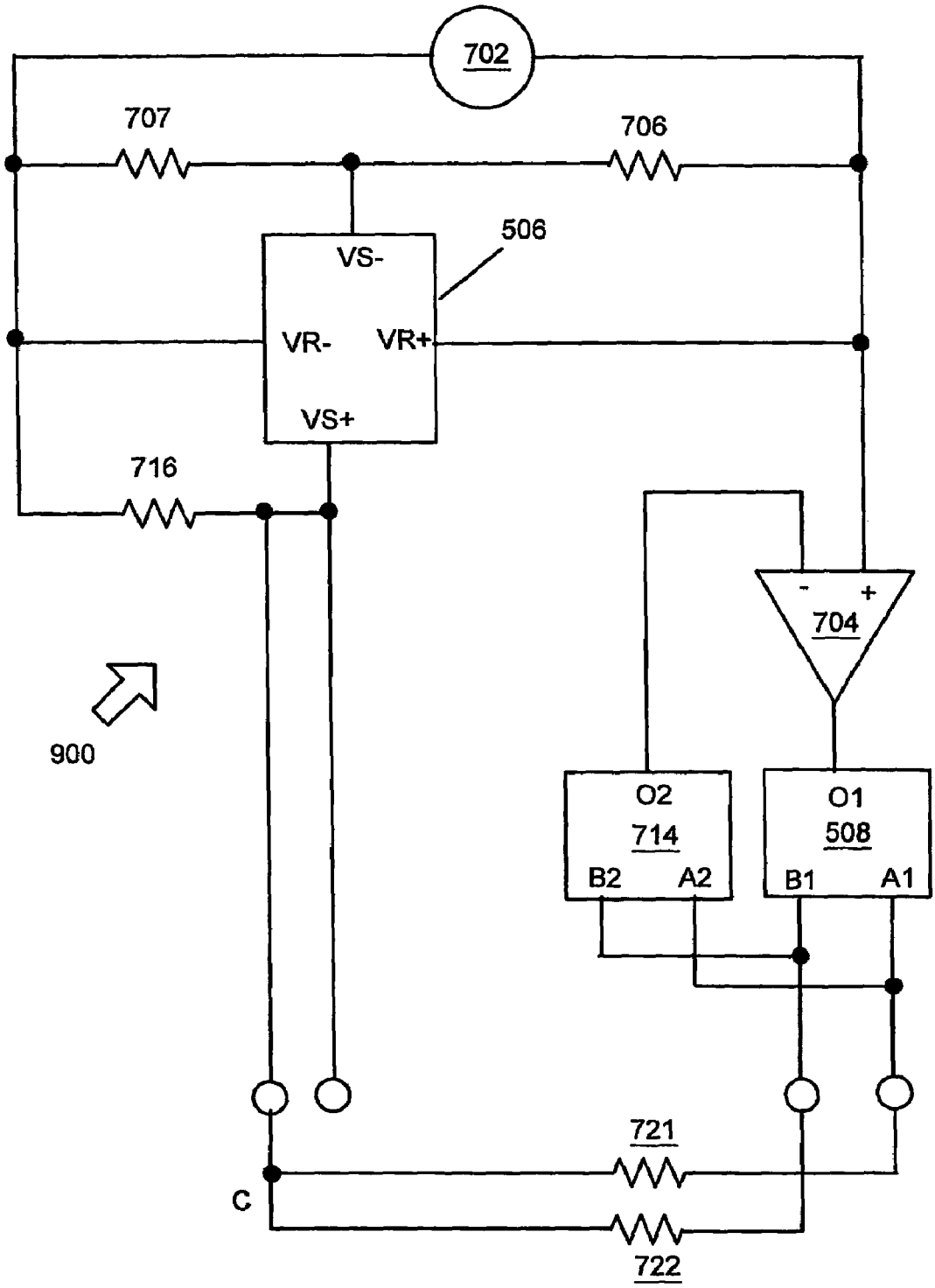
FIG. 10 is a detailed block diagram of another embodiment of a data logger.

With reference to FIG. 10, another embodiment 900 of a data logger also omits multiplexer 718. The strain gauges 721, 722 are again coupled at node C but this time the return conductors are connected locally at the data logger instead of remotely. To sample a number n of strain gauges, n conductors are connected to multiplexer 508 and n conductors are connected in common at completion resistor 716. The n conductors connected in common at the completion resistor 716 serve as both return and signal paths. This embodiment does not compensate for conductor resistance-temperature effects as do the embodiments of FIGS. 8 and 9, but does allow for reduced conductor count as compared to the embodiment of FIG. 8.

Figure 11:
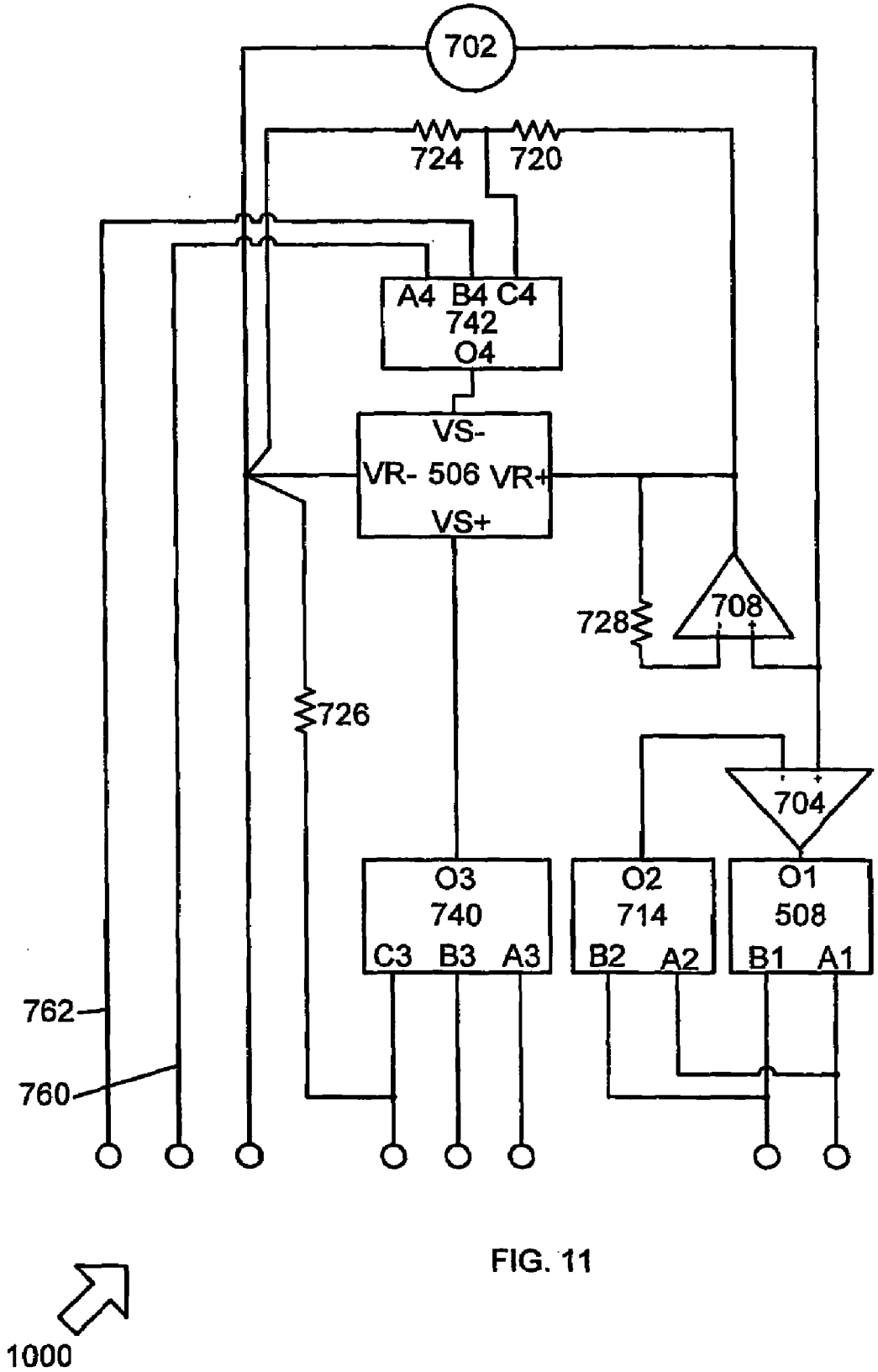
FIG. 11 is a detailed block diagram of another embodiment of a data logger.

Referring to FIG. 11, another embodiment 1000 of a data logger is shown. Embodiment 1000 includes a non-inverting input multiplexer 740 and an inverting input multiplexer 742 coupled to the inputs of an ADC 506 at VS+ and VS−, respectively. The excitation source in embodiment 1000 includes a supply 702 and amplifiers 704 and 708. A voltage divider circuit comprising resistors 720 and 724 provides a reference input at an input C4 of multiplexer 742. A multiplexer 508 has outputs A1, B1 for coupling to respective sensors (e.g., strain gauges). The data logger 1000 can be used in conjunction with any number of various sensors, such as full-bridge sensors (FIG. 13), half-bridge sensors (FIG. 14), and quarter-bridge sensors (FIGS. 15 and 16), and with any combination of such sensors. For example, data logger 1000 can be operated to sequence between a full-bridge sensor, a half-bridge sensor, and a quarter-bridge sensor. The circuits of FIGS. 13-16 are described in greater detail below.

A feedback loop is formed through multiplexer 714 from a selected output A1, B1 of multiplexer 508 to the inverting side of amplifier 704. The feedback loop compensates for the resistive losses through multiplexer 508, and thereby maintains the voltage at a selected output A1, B1 substantially at the reference voltage as provided to the non-inverting input of amplifier 704. Amplifier 708 is selected to balance any errors induced by amplifier 704 and multiplexer 714 on the non-inverting side of ADC 506. The output of amplifier 708 drives the reference voltage input VR+ of ADC 506 such that the voltage at VR+ is substantially the same as the voltage at a selected output A1, B1 of multiplexer 508. A resistor 728 can be added to the feedback loop of amplifier 708 to create a thermocouple on the inverting side of ADC 506 to compensate for the thermocouple created by multiplexer 714 on the non-inverting side of ADC 506.

Figure 15:
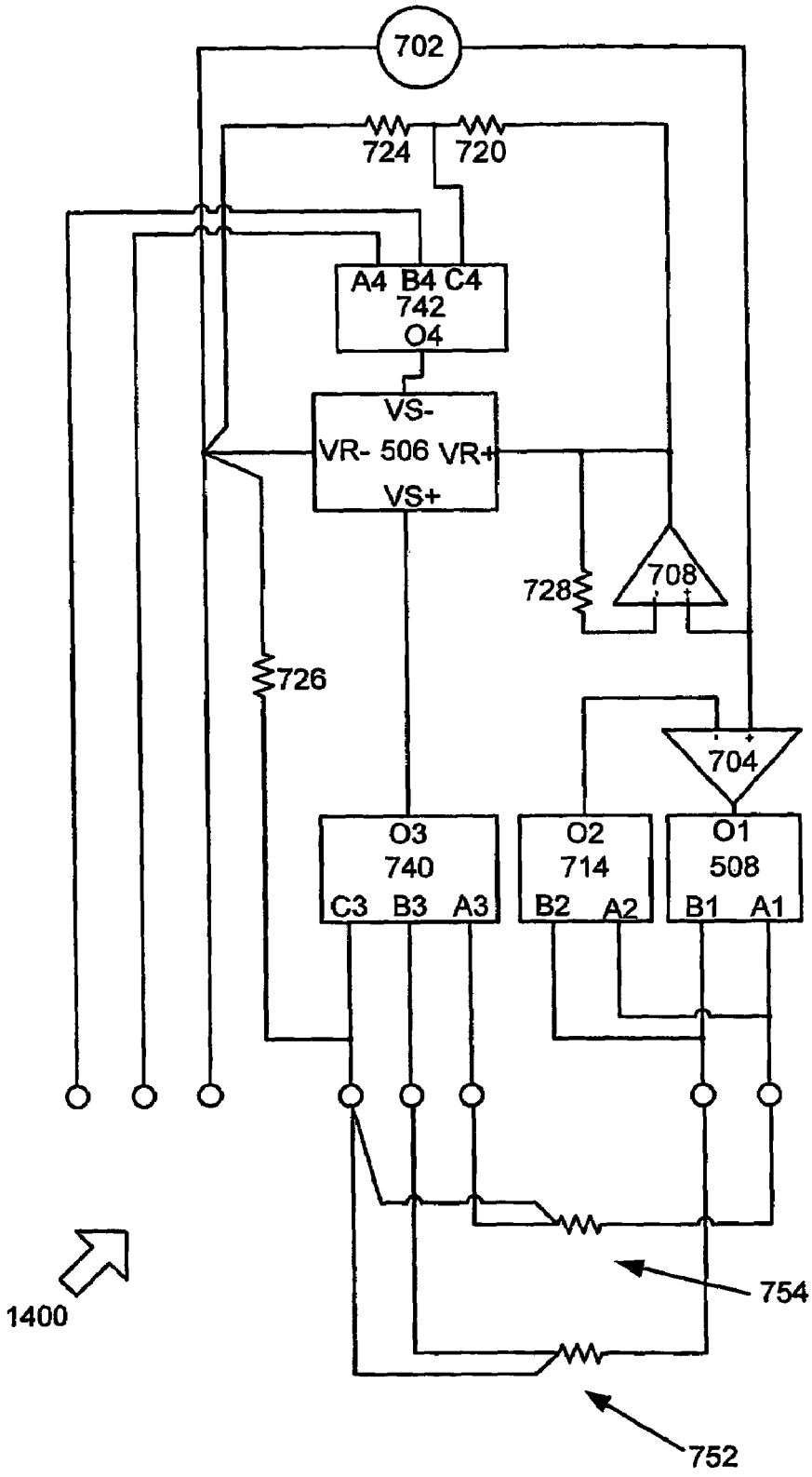
FIG. 15 is a detailed block diagram of the data logger of FIG. 11 shown electrically coupled to two quarter-bridge strain gauge sensors.
Figure 16:
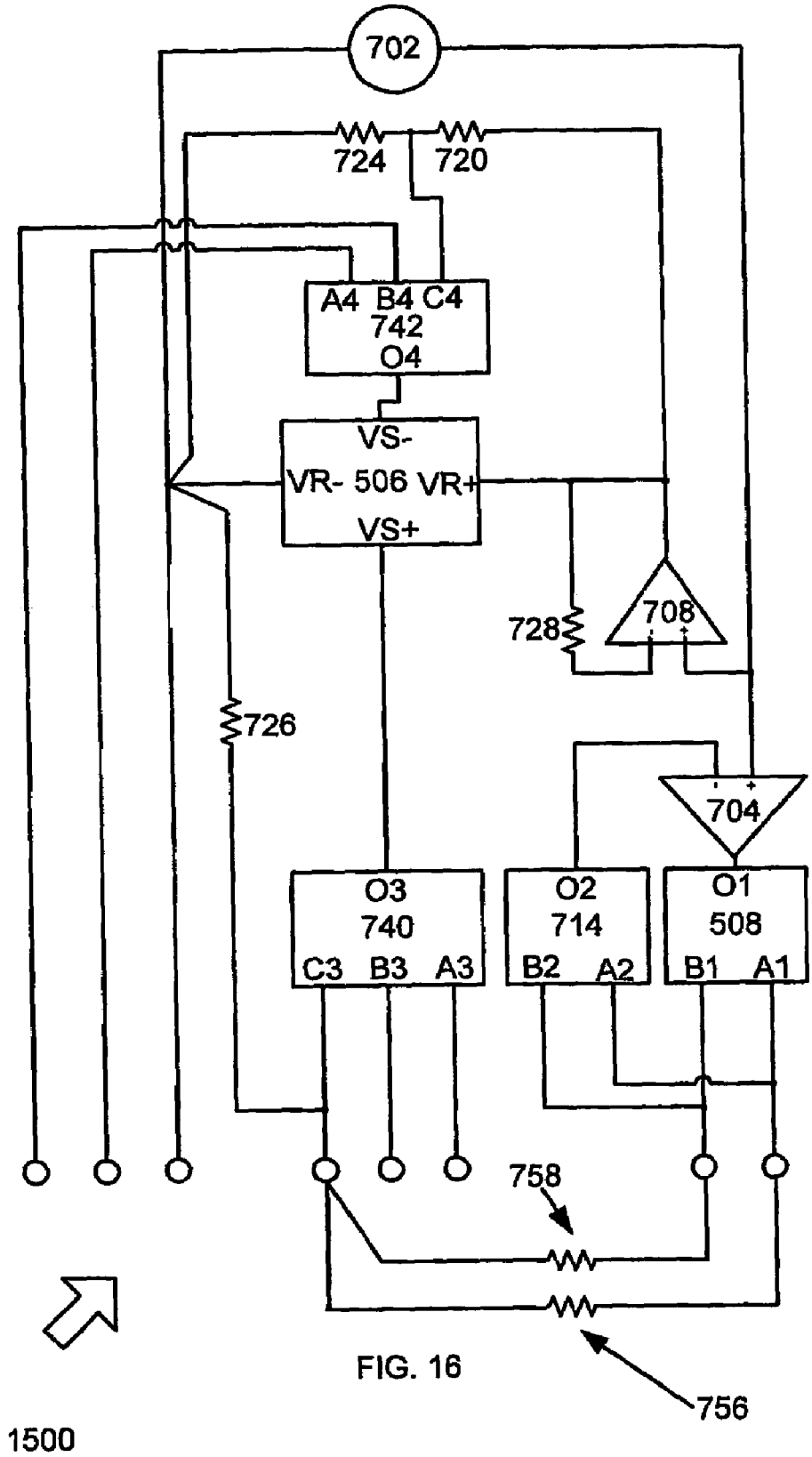
FIG. 16 is a detailed block diagram of the data logger of FIG. 11 shown electrically coupled to two quarter-bridge strain gauge sensors.

Multiplexer 740 couples, in response to signals from a controller, signals from a selected sensor to the non-inverting input VS+ of ADC 506. If quarter-bridge sensors are used (such as shown in FIGS. 15 and 16), a completion resistor 726 may be provided for completing the bridge of such sensors, otherwise completion resistor 726 can be omitted.

Conductors 760 and 762, connected to inputs A4 and B4, respectively, of multiplexer 742, can be used for electrically coupling the return conductors of any full-bridge sensors (FIG. 13) to multiplexer 742. However, if full-bridge sensors are not used, then conductors 760, 762 can be omitted. Multiplexer 742 couples, in response to signals from the controller, signals from a selected sensor to the inverting input VS− of ADC 506. In this manner, multiplexer 742 allows the data logger 1000 to sequence between different types of sensors. For example, if a full-bridge sensor (FIG. 13) is selected, multiplexer 742 selects the input (either A4 or B4) that is coupled to the return conductor of the selected sensor to complete a circuit between the selected sensor and the inverting input VS− of ADC 506. On the other hand, if a half-bridge sensor (FIG. 14) or quarter-bridge sensor (FIGS. 15 and 16) is selected, multiplexer 742 selects input C4 to complete a circuit between the inverting side VS− of ADC 506 and a node between resistors 720 and 724.

In particular embodiments, current limiting resistors or other circuit protection devices may be used. FIG. 12, for example, shows a data logger 1100 that is similar to data logger 1000 of FIG. 11 in all respects except that data logger 1100 incorporates a plurality of current limiting resistors 730, 731, 732, 733, 734, 735, 736, 737, and 738. Resistor 725 can be added to the feedback loop of amplifier 708 to compensate on the inverting side of ADC 506 for the thermocouples created by resistors 735 and 736 on the non-inverting side of ADC 506. Resistor 723 can be added to compensate on the inverting side of ADC 506 for the thermocouples created by resistors 732, 733, and 734 on the non-inverting side of ADC 506.

Figure 13:
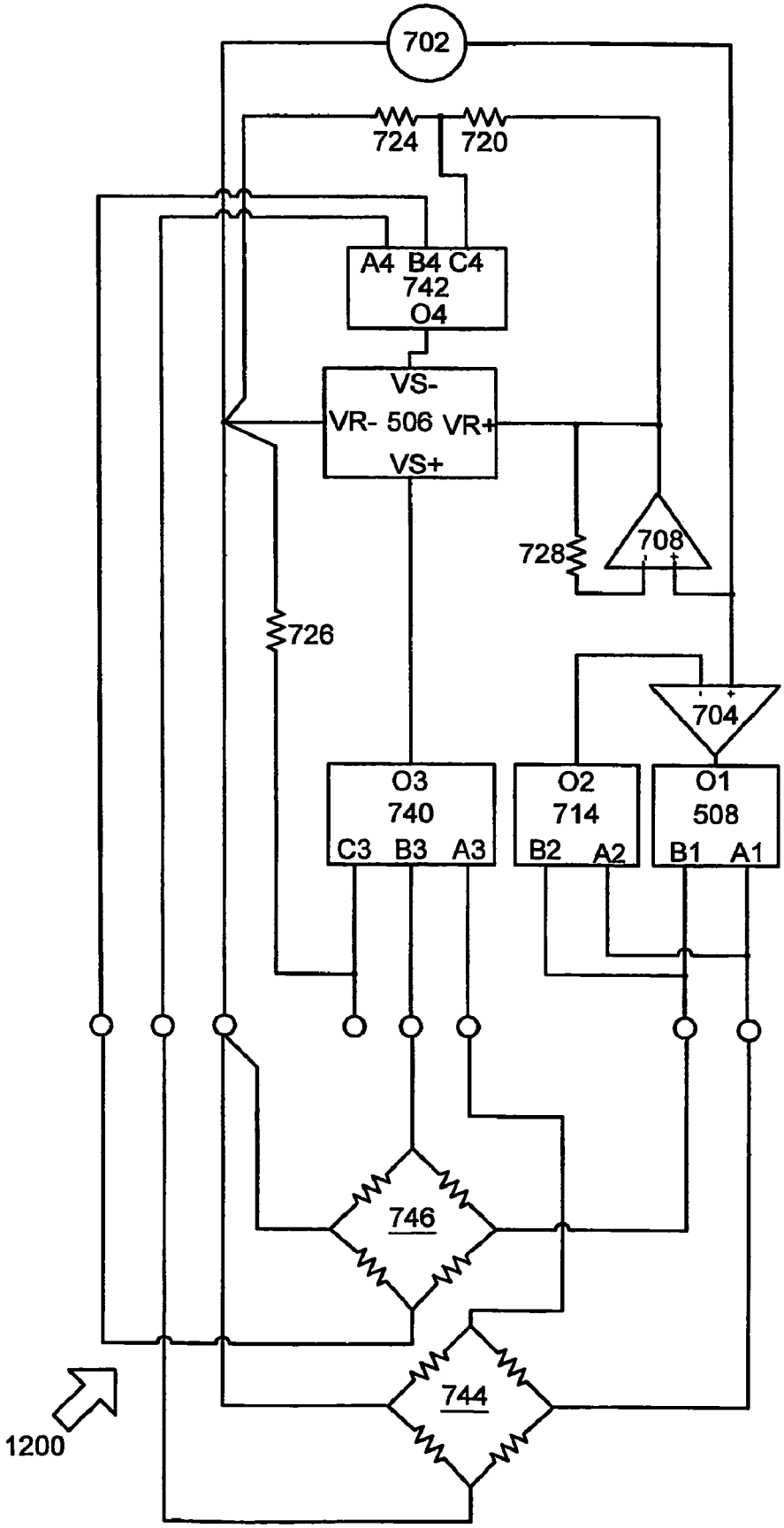
FIG. 13 is a detailed block diagram of the data logger of FIG. 11 shown electrically coupled to two full-bridge strain gauge sensors.

FIG. 13 illustrates an embodiment 1200 comprising the data logger of FIG. 11 coupled to first and second full-bridge sensors 744 and 746, respectively. When the first sensor 744 is selected for sampling, multiplexer 508 will select input O1 to output A1, multiplexer 714 will select input A2 to output O2, multiplexer 740 will select input A3 to O3, and multiplexer 742 will select input A4 to output O4. When the second sensor 746 is selected for sampling, multiplexer 508 will select input O1 to output B1, multiplexer 714 will select input B2 to output O2, multiplexer 740 will select input B3 to O3, and multiplexer 742 will select input B4 to output O4. In this embodiment, completion resistor 726 and the voltage divider formed by resistors 720, 724 are not required.

Figure 14:
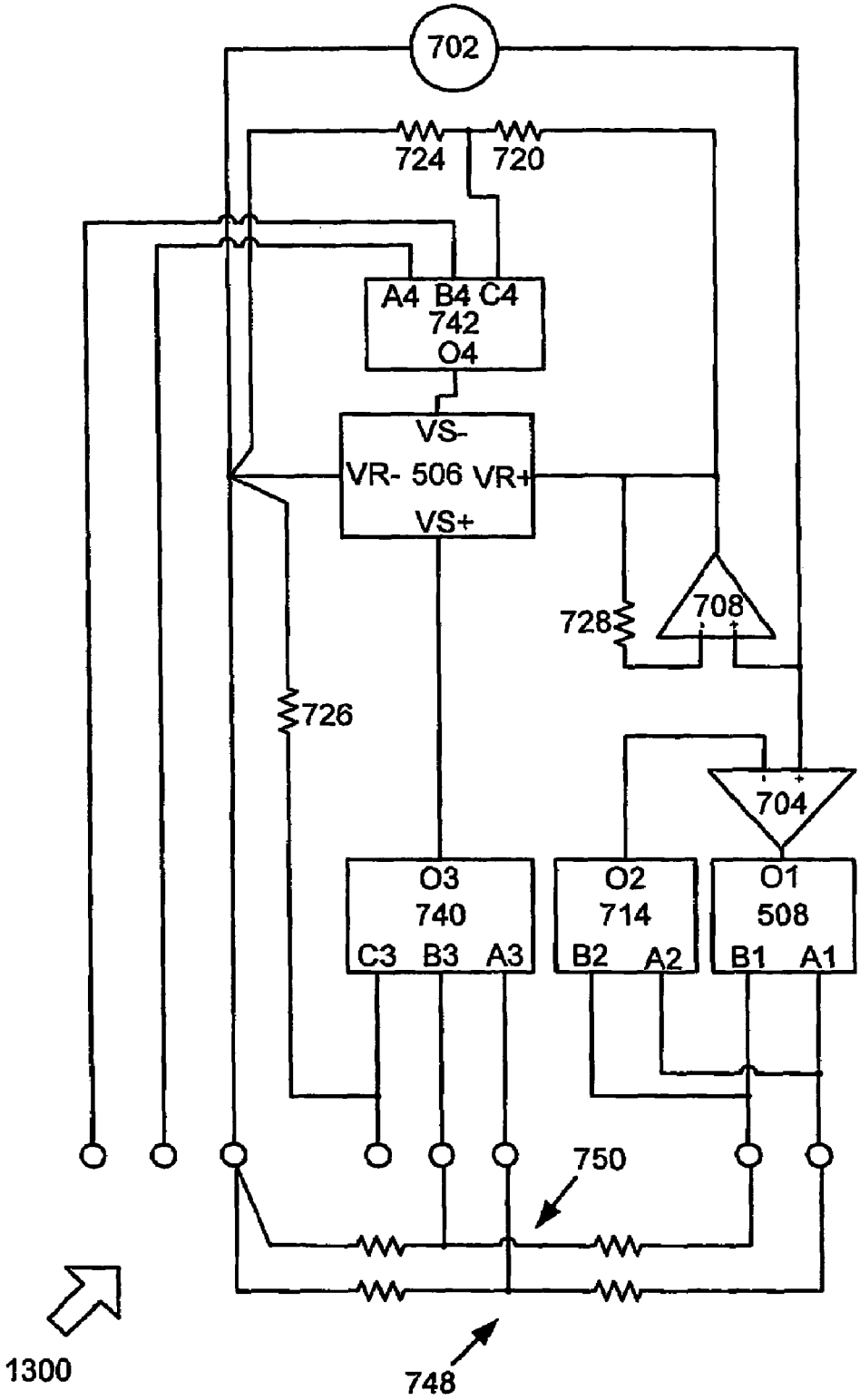
FIG. 14 is a detailed block diagram of the data logger of FIG. 11 shown electrically coupled to two half-bridge strain gauge sensors.

FIG. 14 illustrates an embodiment 1300 comprising the data logger of FIG. 11 coupled to first and second half-bridge sensors 748 and 750, respectively. When the first sensor 748 is selected for sampling, multiplexers 508, 714, 740, and 742 select output A1, input A2, input A3, and input C4, respectively. When the second sensor 748 is selected for sampling, multiplexers 508, 714, 740, and 742 select output B1, input B2, input B3, and input C4, respectively. In a modification to embodiment 1300, multiplexer 742 may be replaced with a resistor coupling the inverting input VS− to a node between resistors 720 and 724. If current limiting resistors 733 and 734 (FIG. 12) are used, an additional resistor can be added in series between the inverting input VS− and the node between resistors 720 and 724 to compensate for the thermocouples created by resistors 733 and 734.

FIG. 15 illustrates an embodiment 1400 comprising the data logger of FIG. 11 coupled to first and second "3-wire" quarter-bridge sensors 752 and 754, respectively. The return conductors of sensors 752 and 754 in this embodiment are coupled to completion resistor 726. When the first sensor 752 is selected for sampling, multiplexers 508, 714, 740, and 742 select output A1, input A2, input A3, and input C4, respectively. When the second sensor 754 is selected for sampling, multiplexers 508, 714, 740, and 742 select output B1, input B2, input B3, and input C4, respectively. As described above in connection with the embodiment of FIG. 14, multiplexer 742 may be replaced with a resistor coupling the inverting input VS− to a node between resistors 720 and 724. In addition, if current limiting resistors 733 and 734 (FIG. 12) are used, an additional resistor can be added in series with the resistor coupling the inverting input VS− to a node between resistors 720 and 724 to compensate for the thermocouples created by resistors 733 and 734.

FIG. 16 illustrates an embodiment 1500 comprising the data logger of FIG. 11 coupled to first and second "2-wire" quarter-bridge sensors 756 and 758, respectively. In this embodiment, the return conductors of sensors 756 and 758 are coupled to completion resistor 726. A controller (not shown) causes multiplexer 740 to select input C3 to output O3 for routing the signals from sensors 756, 758 to the non-inverting input VS+ of ADC 506. The controller also causes multiplexer 742 to select input C4 to output O4 for routing the voltage divider signal created by resistors 720 and 724 to the inverting input VS− of ADC 506. In an alternative embodiment, either one or both of multiplexers 740 and 742 can be omitted. Accordingly, if multiplexer 740 is not used, the voltage divider signal created by resistors 720 and 724 is routed directly to the inverting input VS− of ADC 506, and if multiplexer 742 is not used, the voltage divider signal created by the selected sensor 756 or 758 and the completion resistor 726 is routed directly to the non-inverting input VS+ of ADC 506. In addition, if current limiting resistor 732 (FIG. 12) is used, a resistor can be added between the inverting input VS− of ADC 506 and a node between resistors 720 and 724 to compensate for resistor 732.

Figure 17:
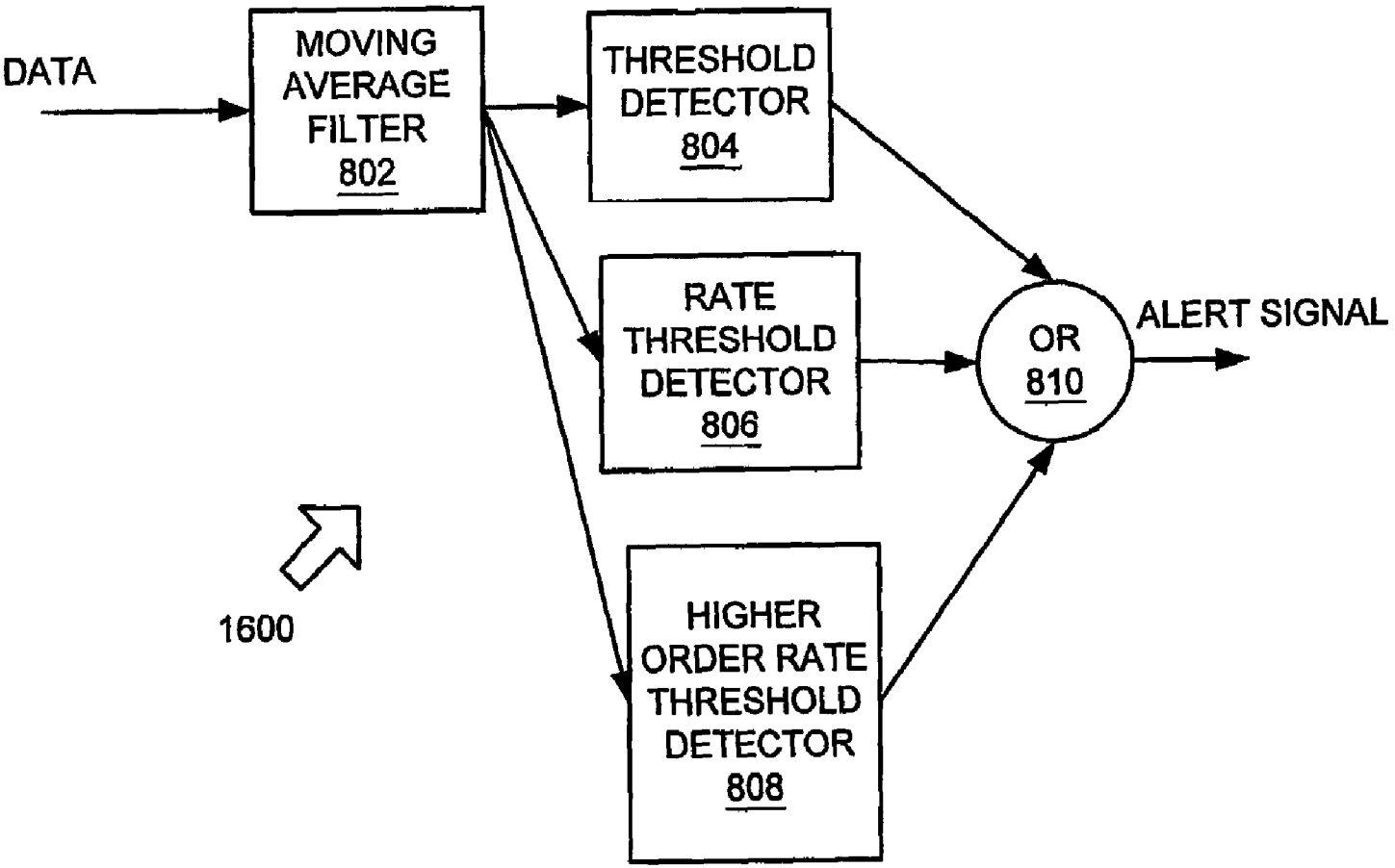
FIG. 17 is a block diagram of an embodiment of a limit detector.

FIG. 17 is a block diagram of an embodiment 1600 of a limit detector. In one embodiment, the limit detector 1600 may be implemented as instructions and data to apply to the controller 604 of the data logger 600. The instructions and data (together, logic) may be comprised by software, firmware, hard-coded circuitry, or any combination of these and other manners of storing and producing instructions and data. Strain data from the memory 602, or from the A/D converter 506, may be provided to a moving average filter 802 which smoothes short-term variations in the signals. In applications where short-term variations in the signals are to be given more weight, the moving average filter 802 can be optional. The strain data may be applied to one or more of a threshold detector 804, a rate threshold detector 806, and a higher order rate threshold detector 808. A threshold detector 804 may assert an output signal when the strain data ranges outside of a predetermined limit. Thus, for example, the threshold detector 804 may assert an output signal when the moving average of the strain data of one or more gauges exceeds a predetermined limit, indicating potentially dangerous stresses building in the surrounding rock. The design and implementation of threshold detectors is well known.

A rate threshold detector 806 may determine the rate at which the strain data is changing, and may assert an output signal when the rate of change of the strain detected by one or more gauges exceeds a predetermined limit, indicating potentially dangerous stresses or instabilities are building in the surrounding rock. The design and implementation of threshold rate detectors is well known.

It may also be possible to detect the onset of instability in rock mass using a higher order rate threshold detector 808. For example, strains in rock mass, and even the rate of change of such strains, may vary over time. In and of itself this may be no cause for alarm, but when the change rate accelerates it may indicate the onset of a cave in. A higher-order rate threshold detector 808 may detect accelerations in the shift rate. The design and implementation of higher order threshold rate detectors is well known.

The outputs of one or more of the threshold detector 804, rate threshold detector 806, and the higher-order rate threshold detector 810 may be combined to produce an alert signal. For example, the outputs may be combined using an OR function 810. The OR function 810 may be implemented in circuits, or logic, or a combination of the two.

Although the limit detector 1600 may comprise additional circuits and logic, it would be understood by those skilled in the art that data logger embodiments may be considered to comprise the limit detector 1600 due to the close cooperation between the two.

Data Logger Interface Software Program

FIGS. 18-23 illustrate a data logger interface software program for controlling certain operating parameters of a data logger and for downloading and displaying data recorded by the data logger. In one implementation, the program is implemented in the DELPHI™ programming language of Borland Software Corp. of Scottsvalley, Calif. and is configured to run on a computer having the WINDOWS operating system of Microsoft Corporation of Redmond, Wash. Alternatively, other languages and operating systems can be used.

The software programs described herein are stored on a computer-readable medium and executed on a general-purpose computer. It should be understood, however, that the invention is not limited to any specific computer language, program, operating system or computer. In addition, those of ordinary skill in the art will recognize that devices of a less general-purpose nature, such as hardwire devices, or the like, may also be used.

The illustrated data logger interface program is adapted for use with a data logger being used to collect data from one or more strain gauges. Accordingly, and by way of example, the following description proceeds with reference to the use of a data logger for logging data from one or more strain gauges. However, the program can be adapted for use with a data logger being used to collect data from sensors other than strain gauges.

The program displays a plurality of graphical user interface elements that allow a user to set or select certain operating parameters of a data logger (the data logger interfaced with the program is termed "Midas" in FIGS. 18-23). Without limitation, graphical user interface elements can be buttons, checkboxes, drop-down pick lists, edit boxes, pop-up menus, and the like, as generally known in the art. FIGS. 18-23 illustrate an exemplary embodiment for implementing various user interface elements for controlling the operation of a data logger. The types and/or number of interface elements used can be varied in alternative implementations.

Figure 22:
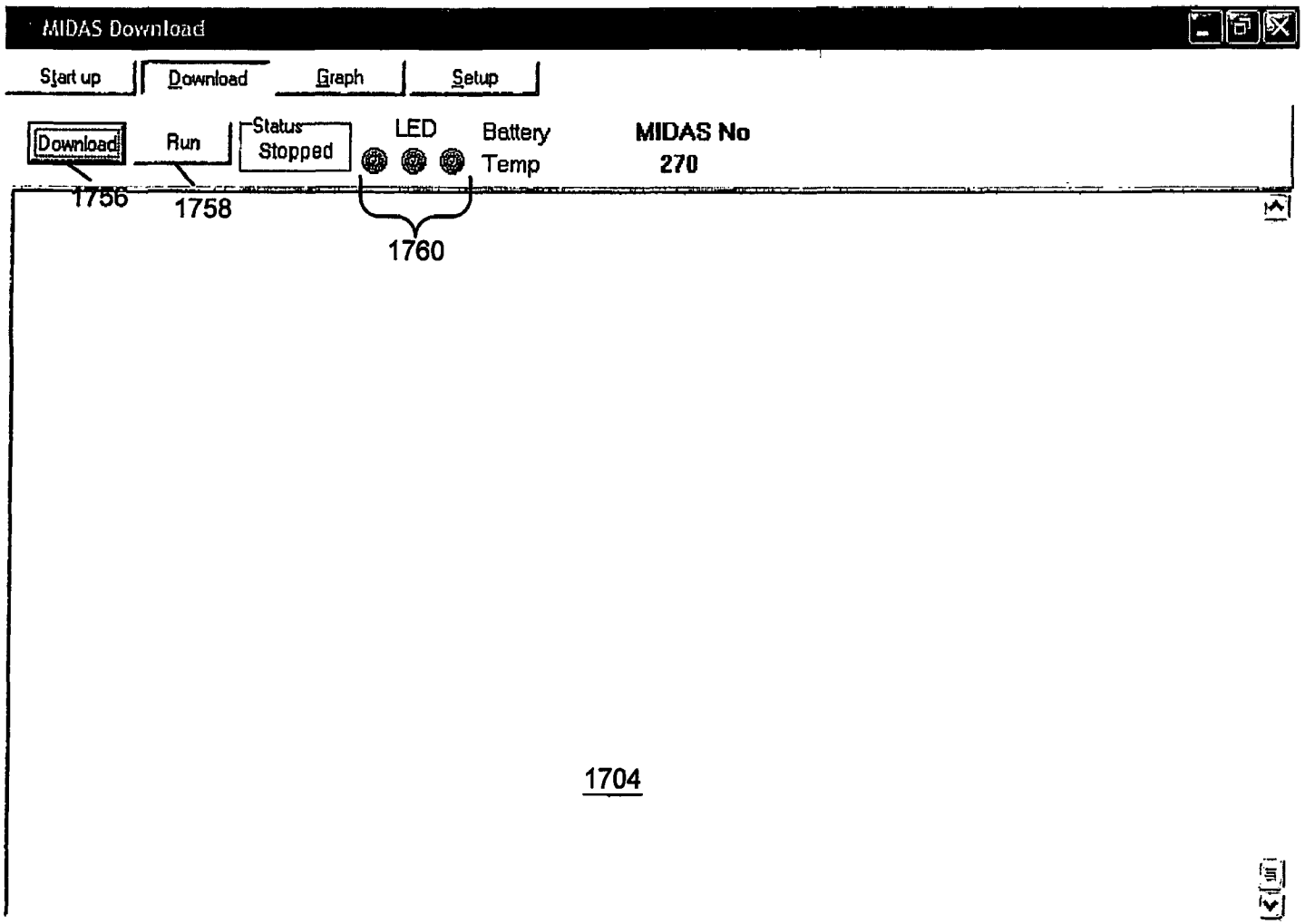
FIG. 22 shows the "Download" screen of the program for downloading strain date from a data logger.
Figure 23:
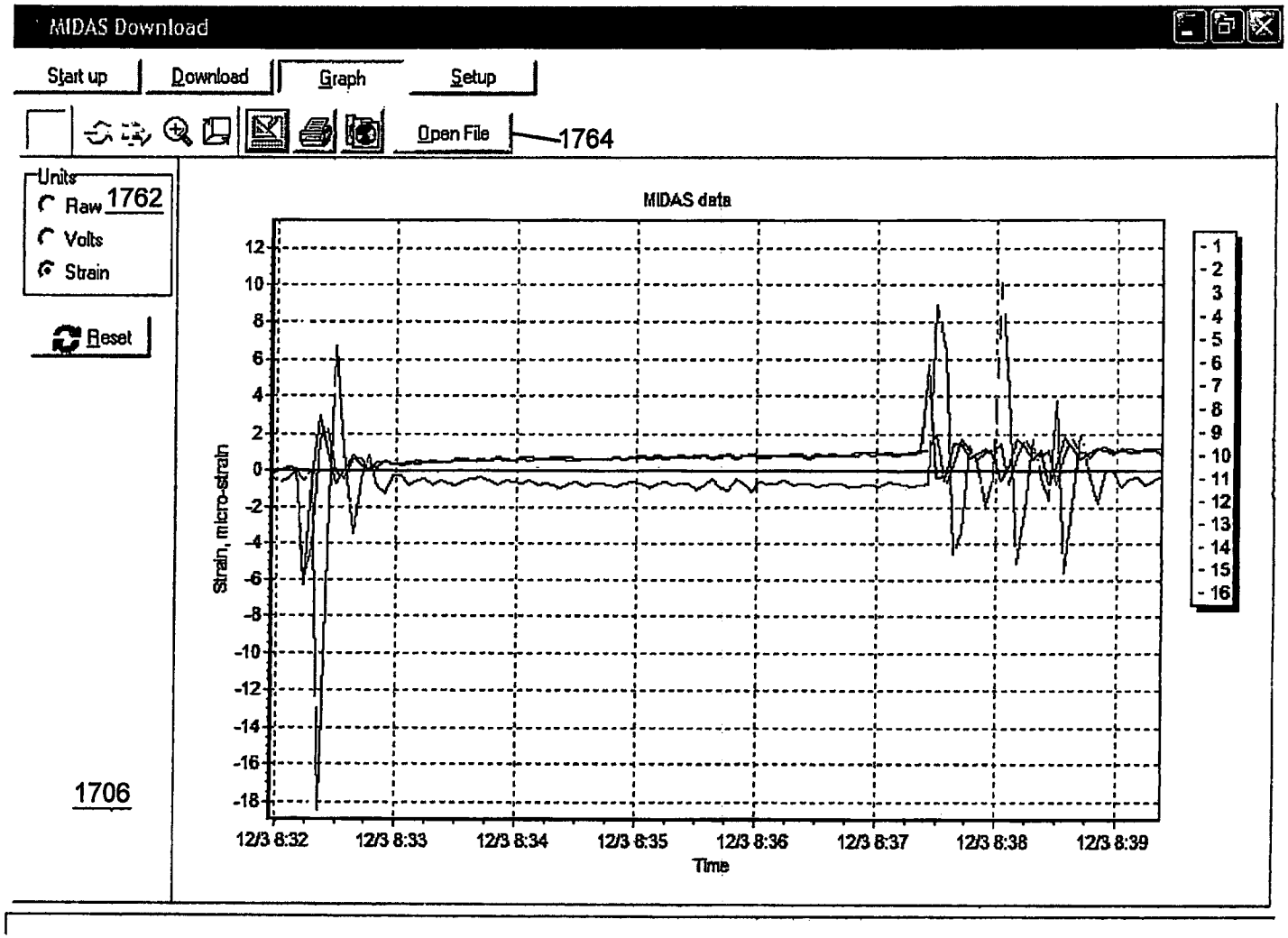
FIG. 23 shows the "Graph" screen of the program for graphing strain data downloaded from a data logger.

The illustrated data logger interface program has four main windows or screens, namely, a "Start up" screen 1700 (FIG. 18), a "Setup" screen 1702 (PIGS. 19-21), a "Download" screen 1704 (FIG. 22), and a "Graph" screen 1706 (FIG. 23). Appropriately labeled buttons at the top of each screen allows a user to navigate between the different screens.

Figure 18:
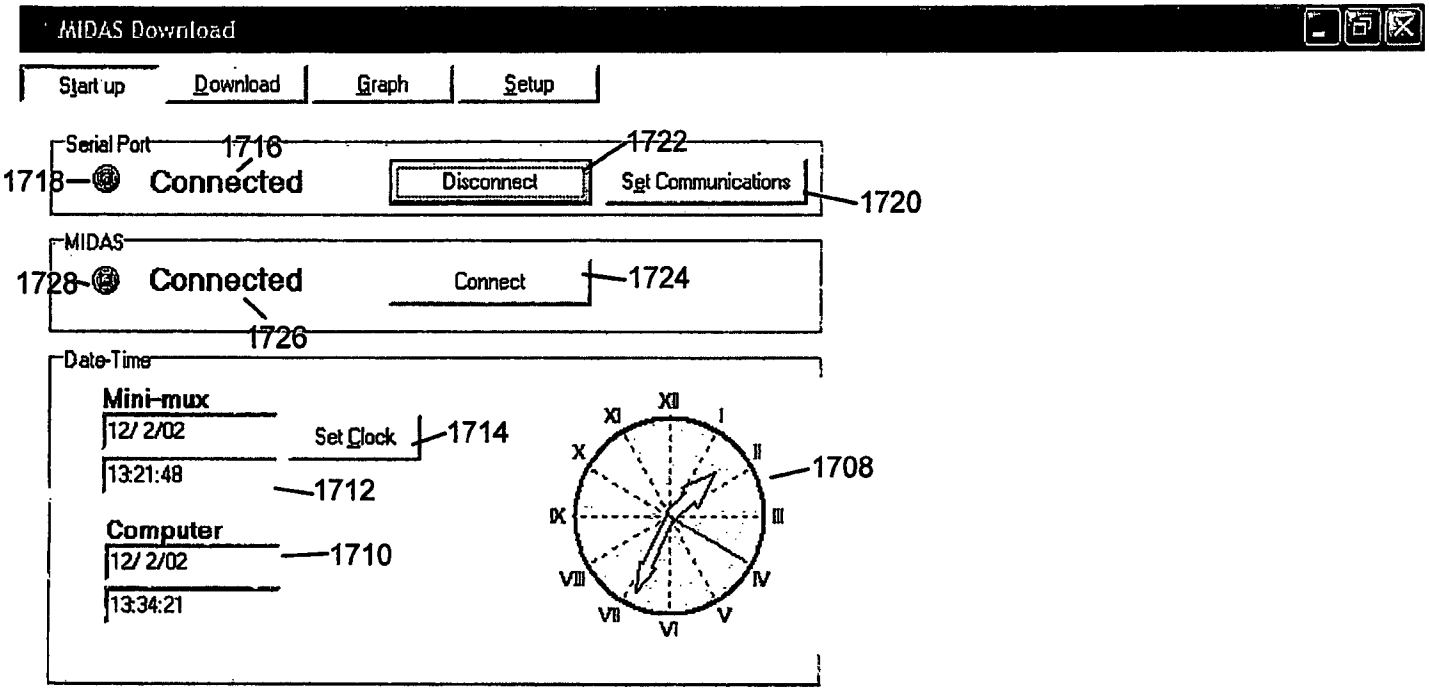
FIG. 18 shows the "Start up" screen of an embodiment of a graphic user interface software program for use in controlling the operation of and retrieving data from a data logger.

Referring to FIG. 18, upon start up of the program, the program displays the Start up screen and automatically opens an available RS232 serial port for communicating with the data logger. The Start up screen indicates at 1716 whether the program has successfully established a communication link with an available serial port on the computer (either "connected," as shown in FIG. 18, to indicate that a communication link has been established or "not connected" to indicate that a communication link has not been established). A graphic representation of an LED light, indicated at 1718, provides another visual indication of the status of the communication link with an available serial port. In particular embodiments, for example, LED 1718 turns green to indicate that the communication link is connected, or red to indicate that the communication link is not connected.

Activation of a "Set Communications" button 1720 opens a pop-up menu (not shown) that allows a user to change the serial port used by the computer to communicate with the data logger. Activation of button 1722 prompts the program to either (1) disconnect or interrupt the communication link between the program and the selected serial port or (2) connect or establish a communication link between the program and the selected serial port, depending on the current connection status.

Activating button 1724 prompts the program to send a signal to the data logger, which in response sends the program the current operating parameters of the data logger (described below). The Start up screen indicates at 1726 the status of the communication link between the program and the data logger (either "connected," as shown in FIG. 18, to indicate that a communication link with the data logger has been established or "not connected" to indicate that a communication link with the data logger has not been established). A graphic representation of an LED light, indicated at 1728, provides another visual indication of the status of the communication link between the program and the data logger, such as by turning green to indicate that the communication link is connected, or red to indicate that the communication link is not connected.

The Start up screen 1700 also displays the computer's clock at 1708 and 1710 and the data logger's clock at 1712. A "Set Clock" button 1714 allows a user to set the date and time of the data logger to correspond to that of the computer.

Figure 19:
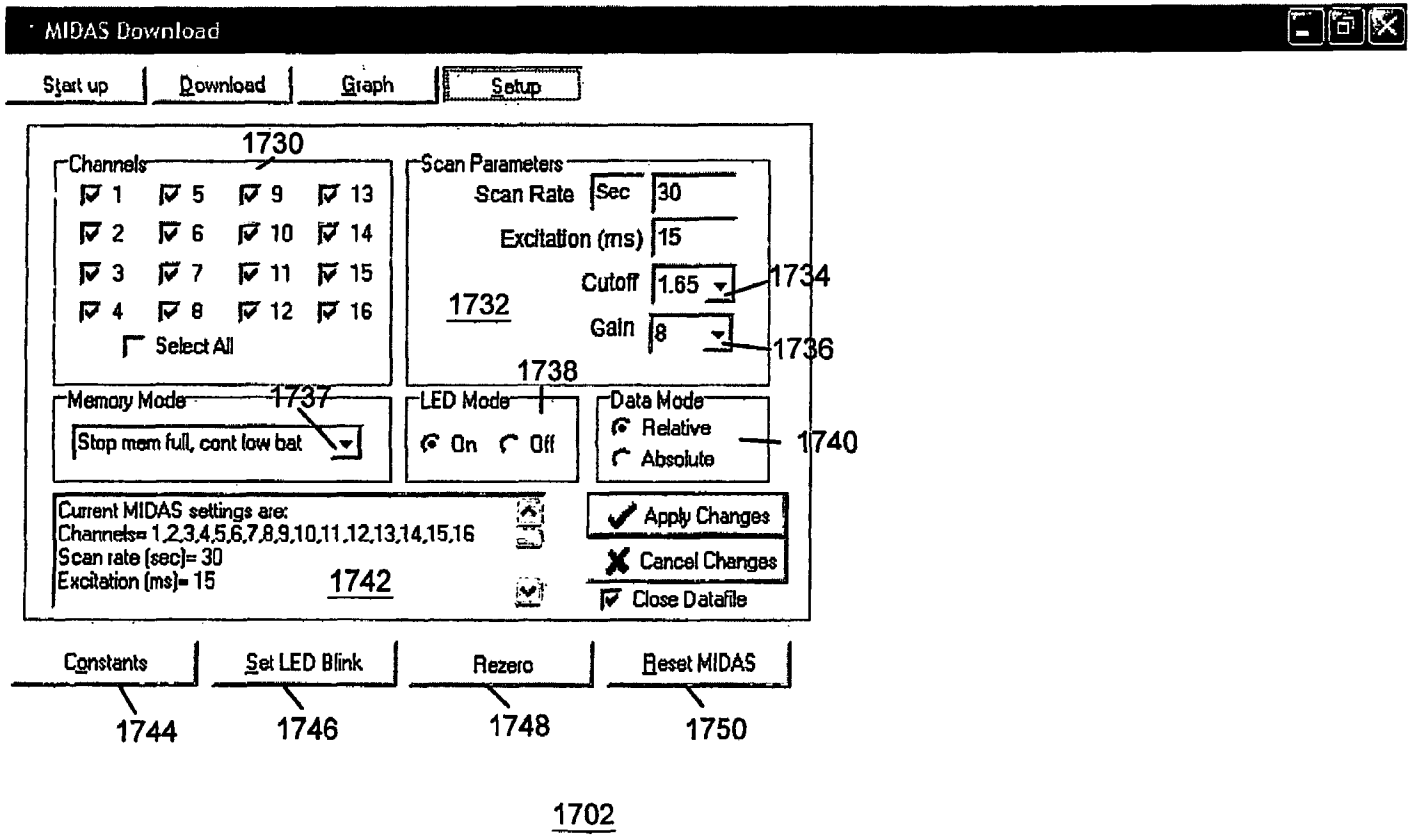
FIG. 19 shows the "Setup" screen of the software program.
Figure 20:
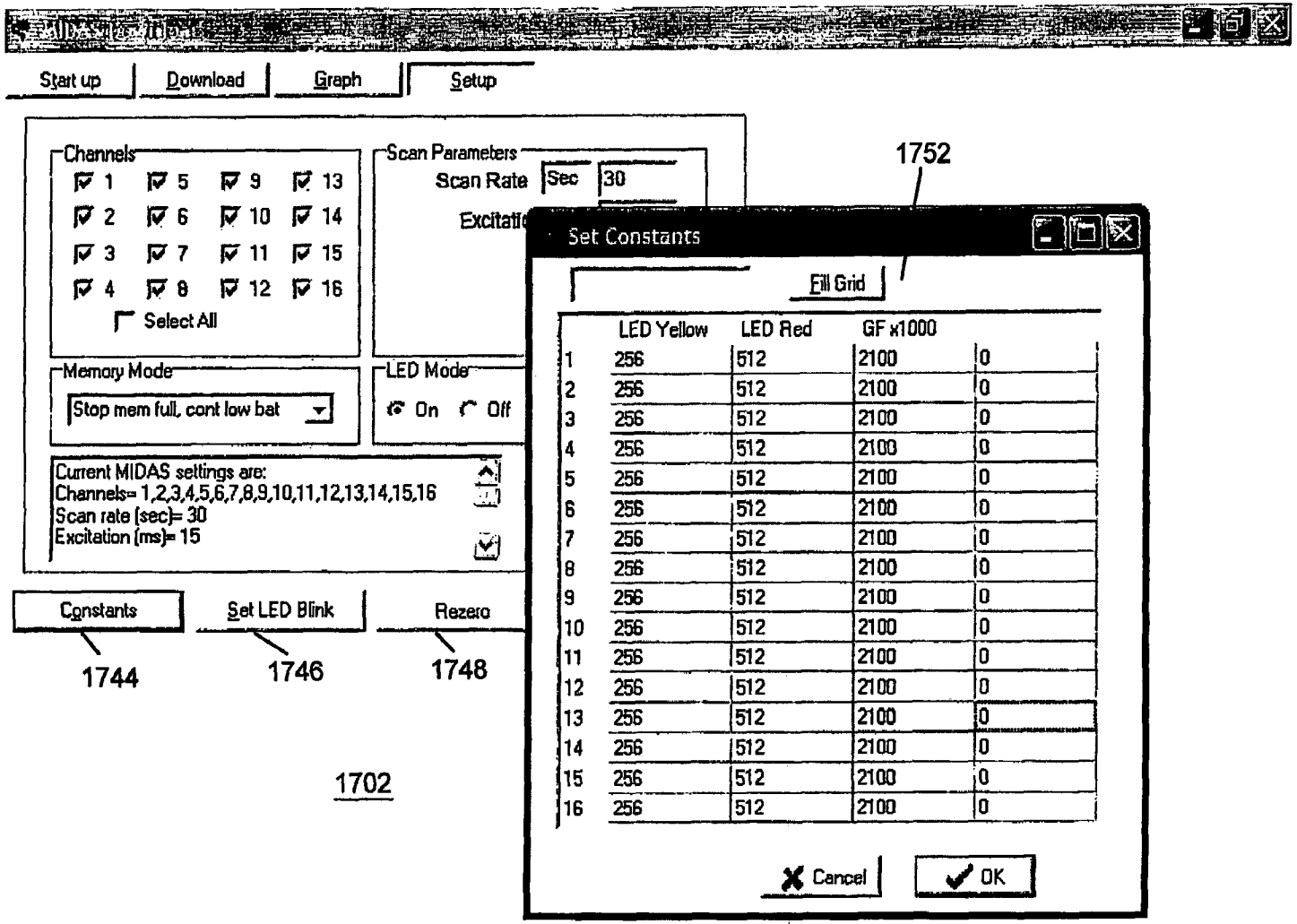
FIG. 20 shows the "Setup" screen with the "Set Constants" palette open for setting certain operating parameters of the data logger.
Figure 21:
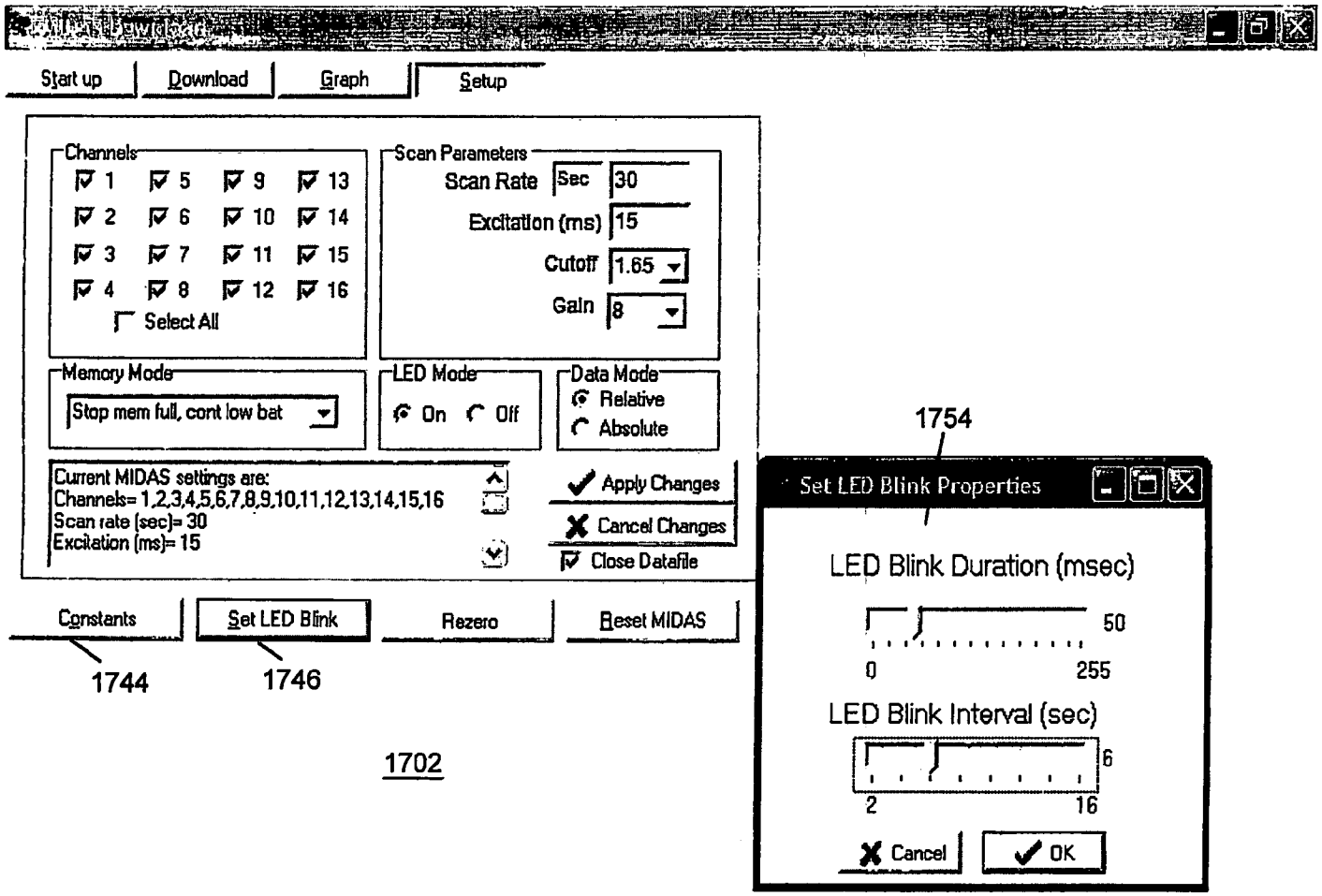
FIG. 21 shows the "Setup" screen with the "Set LED Blink Properties" palette open for setting the blink properties of the LEDs of the data logger.

The Setup screen 1702, shown in FIG. 19, allows a user to set certain operational parameters of the data logger and program. As shown, the Setup screen includes a tablet 1730 that includes a plurality of check boxes, each corresponding to a strain gauge. This allows a user to select the strain gauges that are to be sampled by the data logger. Tablet 1732 allows a user to set certain "scan" parameters of the data logger, namely, the scan rate (i.e., the duration between successive readings of a strain gauge), the excitation time (i.e., the length of time that a strain gauge is energized by the data logger before the signal from the strain gauge is recorded by the data logger), the cutoff frequency of a signal filter of the ADC of the data logger (e.g., 1.65 Hz, 3.31 Hz, 6.6 Hz, 13.2 Hz, 26 Hz, 53 Hz, 104 Hz, 196 Hz, 332 Hz, or 665 Hz), and the gain of an instrumentation amplifier of the ADC (e.g., 1, 2, 4, 8, 16, 32, or 64). Pull down menus 1734 and 1736 are provided for selecting a desired value for the cutoff frequency and gain, respectively.

A pull down menu 1737 allows a user to select one of the following four "memory modes": (1) a "stop mem full, cont low bat" mode, in which the data logger continues sampling if the battery is low but stops sampling if its memory is full; (2) a "cont mem full, cont low bat" mode, in which the data logger continues sampling even if its memory is full and the battery is low; (3) "cont mem full, stop low bat" mode, in which the data logger continues sampling if its memory is full but stops if the battery is low; and (4) "stop mem full, stop low bat" mode, in which the data logger stops sampling if its memory is full or the battery is low. If the data logger continues to operate after its memory becomes full (options 2 and 3), data is echoed to the serial port of the computer so that the program can store the data in a data file.

A tablet 1738 allows a user to turn on and off the LED lights of the data logger (e.g., LEDs 558*a*, 558*b*, and 558*c* of FIG. 6A), and a tablet 1740 allows a user to select either a "relative" or "absolute" mode for recording data. In the relative mode, the data logger records data corresponding to strain measured by each strain gauge relative to an initial point in time at which strain is initialized or set at zero. In the absolute mode, the data logger records data corresponding to strain measured by each strain gauge with respect to a reference value that is reset to zero after each scan interval (i.e., after each time a gauge is sampled). The current settings for the data logger are displayed in an information window 1742.

The Setup screen also includes buttons 1744, 1746, 1748, and 1750. Activation of button 1744 opens a "Set Constants" palette 1752 (FIG. 20), in which a user can set the threshold strain values at which the LED lights change from green to yellow and yellow to red, and the strain gauge factor for each strain gauge. Activation of button 1746 opens a "Set LED Blink Properties" palette 1754 (FIG. 21) that has two slides bars, one of which controls the blink duration of the LED lights and the other of which controls the blink interval of the LED lights. Activating button 1748 (labeled "Rezero") causes the program to "rezero" the data logger when data is being collected in the relative mode. This causes the data logger to establish a new starting point with a zero reference value from which subsequent strain data is measured. The memory of the data logger can be reset by activating button 1750.

Referring to FIG. 22, the download screen 1704 includes a "Download" button 1756 and a "Run" button 1758. The Run button 1758 serves as an on/off switch for controlling the operation of the data logger. Thus, activating the Run button prompts the data logger to begin sampling the strain gauges. Activating the Run button again causes the data logger to stop sampling the strain gauges.

Activating the Download button 1756 prompts the program to download all strain data from the data logger to the computer and convert all downloaded data from its current format (in particular embodiments, the data logger stores data in hexadecimal format) into microstrain and millivolts. The downloaded strain data, in hexadecimal format and in microstrain and millivolts, can be written into one or more files. In the illustrated embodiment, for example, all strain data is written into a spreadsheet file, which can then be used to generate various graphs in the Graph screen 1706, as further described below. The spreadsheet file also can be accessed from within the user interface program described below in connection with FIGS. 24 and 25.

As further shown FIG. 22, the Download screen also includes an alerting device in the form of warning lights, indicated at 1760. In particular embodiments, lights 1760 mimic the operation of LEDs 558*a*, 558*b*, and 558*c* of the data logger 550 shown in FIG. 6A. In this manner, LEDs 1760 serve as a remote alerting device to allow a user to monitor for excessive strains if the local LEDs of the data logger are not easily accessible for viewing. The program also can implement other types of alerting devices, such as an audible alarm, to warn a user of unusual or excessive strains.

The Graph screen 1706, illustrated in FIG. 23, includes a display area for graphing strain data from each strain gauge as a function of time. Opening the Graph screen automatically generates a strain v. time graph for each strain gauge from the strain data most recently downloaded. If the graph screen is opened as data is being downloaded, the program automatically generates such graphs in real time to permit monitoring of strains as they occur. In the illustrated embodiment, each graph is a different color and a color legend is provided to enable identification of each graph with its corresponding strain gauge. The downloaded data can also be displayed in volts or as unconverted raw data (in the illustrated embodiment, each measurement is represented by a 24 bit number), by selecting the desired units in the "Units" tablet 1762. Within the Graph screen 1706, a previously downloaded data set can be accessed for graphing by activating the "Open File" button 1764.

User Interface Program for Displaying Strain Data

Figure 24:
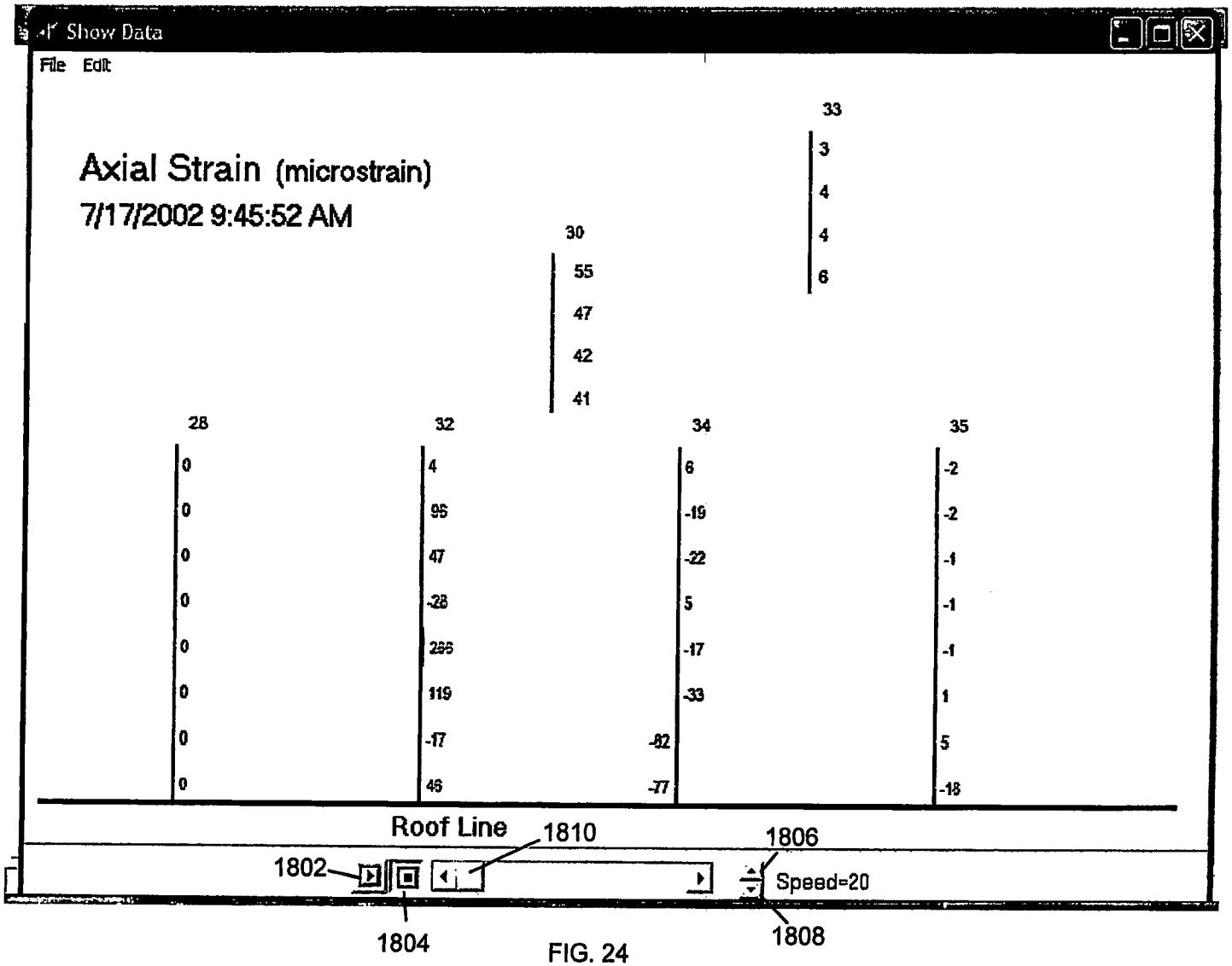
FIG. 24 shows a screen shot of a graphic user interface software program according to one embodiment for displaying strain data from multiple instrumented rock bolts in a mine.
Figure 25:
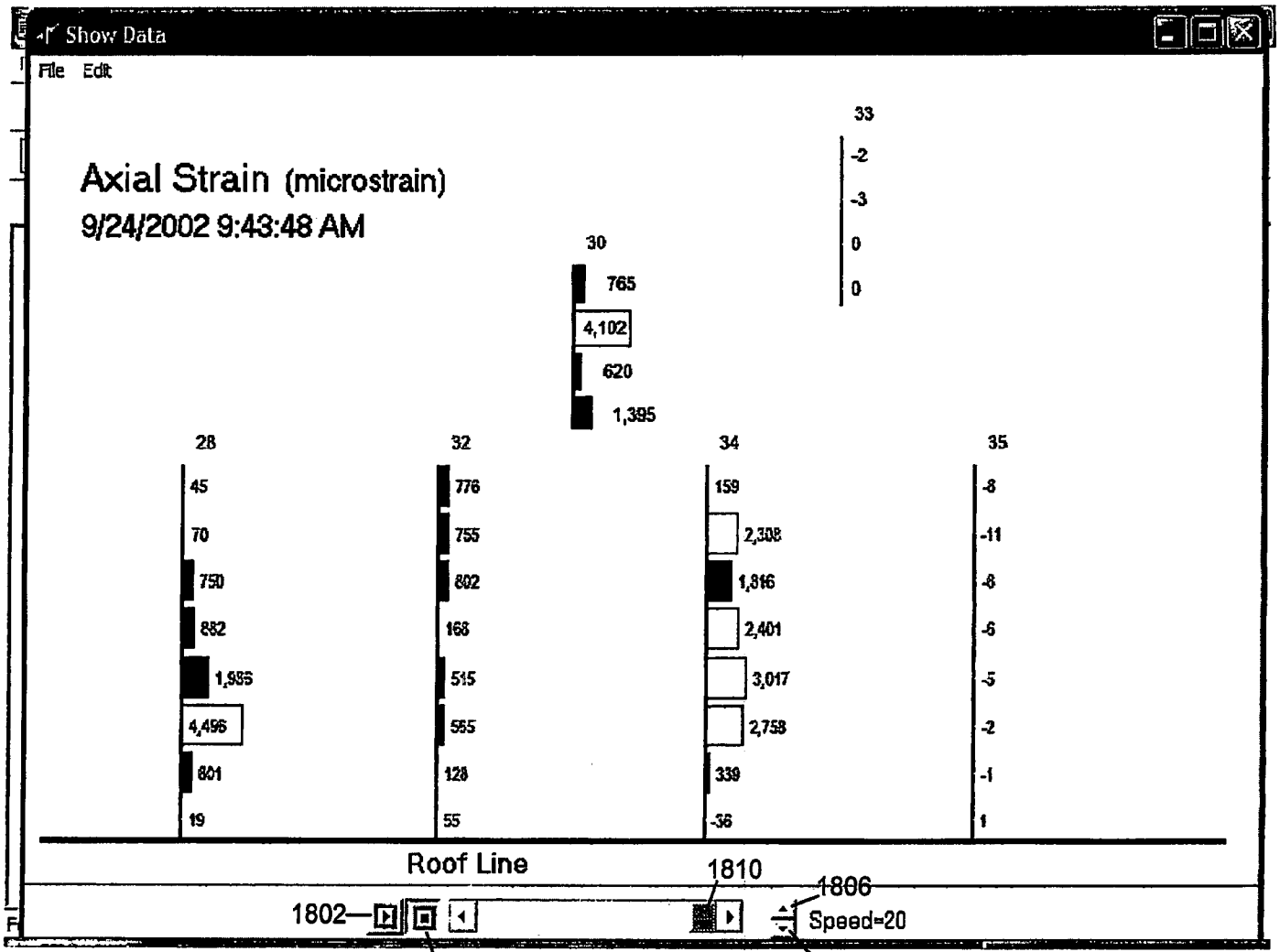
FIG. 25 is a screen shot similar to FIG. 24 displaying strain data measured at the end of a data collecting period.

FIGS. 24 and 25 illustrate a graphic user interface program that displays strain data in a format that allows for identification of unusual trends in strains measured in a structure, such as a rock mass in an underground mine. In one implementation, the program is implemented in the DELPHI™ programming language and is configured to run on a computer having the WINDOWS operating system, although other languages and operating systems also can be used.

The program can be used to display strain data in real time or strain data previously saved in a data file. In one implementation, the program interfaces with the data logger software program of FIGS. 18-23 to read data as it is being downloaded from a data logger. In an alternative implementation, the program interfaces directly with a data logger to download and read data from the data logger. To display a set of data from a previously saved data file, the data file is selected and opened from the File pull-down menu (FIG. 24). In particular embodiments, the program is configured to read data saved in a spreadsheet file.

As shown in FIG. 24, this program displays a plurality of vertical bars (labeled 28, 30, 32, 33, 34, and 35 in this example), each of which represents a rock bolt equipped with multiple strain gauges and grouted into a rock mass to measure strains induced by the rock mass. Alternatively, the vertical bars can represent other types of support devices that can be equipped with strain gauges and grouted into a rock mass for measuring strain, such as a stress cell. One example of a stress cell adapted for measuring strains in a rock mass is the Hollow Inclusion Cell, manufactured by Mindata Australia of Victoria, Australia. In any case, for each rock bolt, the strain measured at a specific point in time by each strain gauge is displayed as a numeric value (e.g., microstrains) beside its corresponding vertical bar. As shown, the program also displays the date and time that the currently displayed strain data was measured.

The program includes a play button 1802, which, when activated, prompts the program to begin a time-varying display of strain data collected over a collection period in the form of a plurality of bar graphs, each corresponding to a respective strain gauge, with the numerical value for strain shown beside each bar graph (as shown in FIG. 25). The program displays strain data collected for each sampling interval (i.e., each strain gauge reading), from the beginning of the collection period (FIG. 24) to the end of the collection period (FIG. 25). In this manner, the program provides a visual recording of the rate of change in strain for each strain gauge over the collection period. This is advantageous since, in some cases, the rate of change of strain is a better indicator of possible instabilities in the rock mass that can lead to a cave-in than strain itself. A stop button 1804 allows a user freeze the display of strain data at any point in time as the data is being displayed. Up and down arrows 1806 and 1808, respectively, increase and decrease, respectively, the speed at which data is displayed. A scroll bar 1810 allows a user to move the display forward and backward to any point in time in the collection period.

Each bar graph can be colored coded to indicate whether the measured strains have exceeded certain threshold strains. In particular embodiments, for example, the bar graphs are initially green and turn from green to yellow after exceeding a first threshold value and yellow to red after exceeding a second threshold value.

In view of the many possible embodiments to which the principles of the present invention may be applied, it should be recognized that the detailed embodiments are illustrative only and should not be taken as limiting in scope. Rather, the present invention encompasses all such embodiments as may come within the scope and spirit of the following claims and equivalents thereto.

We claim:

1. A rock bolt comprising:

a hollow body comprising a gap along a length of the hollow body;

at least one strain gauge affixed to an inner surface of the hollow body and accessible from the gap;

a data logger located within the hollow body and coupled to receive signals from the at least one strain gauge and to record the signals in a memory; and wherein the at least one strain gauge comprises a plurality of strain gauges affixed to the inner surface of the hollow body and spaced along the length of the hollow body.

2. The rock bolt of claim 1 further comprising:

a data port coupled to the data logger and accessible from an exterior of the rock bolt once the rock bolt is inserted into a bore hole.

3. The rock bolt of claim 2, the data logger further comprising at least one of a threshold detector, a rate threshold detector, and a higher order rate threshold detector, the data logger adapted to activate an alarm when at least one of the threshold detector, rate threshold detector, and higher order rate threshold detector indicate an alert condition.

4. The rock bolt of claim 3 in which the alarm is coupled to the data port.

5. The rock bolt of claim 1 further comprising:

the data logger adapted to provide signals stored in the memory via wireless communication.

6. The rock bolt of claim 1 further comprising:

the data logger comprising a limit detector; and the limit detector adapted to provide an alarm signal via wireless communication.

7. A rock bolt comprising:

a hollow body comprising a gap along a length of the hollow body;

at least one strain gauge affixed to an inner surface of the hollow body and accessible from the gap; and a data logger located within the hollow body and coupled to receive signals from the at least one strain gauge and to record the signals in a memory;

the data logger comprising:

a first multiplexer to couple a selected strain gauge of the at least one strain gauges to an excitation source; and a second multiplexer to couple the selected strain gauge in a feedback loop with a voltage feedback amplifier to the first multiplexer, such that a reference excitation voltage to the selected strain gauge is maintained.

8. A rock bolt comprising:

a hollow body comprising a gap along a length of the hollow body;

at least one strain gauge affixed within the body; and wherein the at least one strain gauge comprises a plurality of strain gauges affixed to the inner surface of the hollow body and spaced along the length of the hollow body.

9. The rock bolt of claim 8 further comprising:

a data logger located within the hollow body of the rock bolt, the data logger coupled to receive signals from the strain gauges and to record the signals in a memory.

10. The rock bolt of claim 9 further comprising:

a data port coupled to the data logger and adapted to be accessible from the outside of a bore hole into which the rock bolt is inserted.

11. The rock bolt of claim 10, the data logger further comprising at least one of threshold detector, a rate threshold detector, and a higher order rate threshold detector, the data logger adapted to communicate with an alarm when at least one of the threshold detector, rate threshold detector, and higher order rate threshold detector indicate an alert condition.

12. The rock bolt of claim 9, the data logger comprising:

a first multiplexer to couple a selected strain gauge of the at least one strain gauges to an excitation source; and a second multiplexer to couple the selected strain gauges in a feedback loop with a voltage feedback amplifier to the first multiplexer, such that a reference excitation voltage to the selected strain gauge is maintained.

13. A data logger comprising:

a controller;

a memory coupled to the controller and to an analog-to-digital converter; and a first multiplexer coupled to the controller, the first multiplexer operable to select, in response to signals from the controller, one of a plurality of sensors to couple to an excitation source;

a second multiplexer to couple the selected sensor in a feedback loop with a voltage feedback amplifier to the first multiplexer, such that a reference excitation voltage to the selected sensor is maintained; and the sensors coupled via a single conductor to the analog-to-digital converter.

14. The data logger of claim 13, further comprising:

a threshold detector to generate an alarm signal based upon signals from at least one of the sensors.

15. The data logger of claim 13, further comprising:

a rate threshold detector to generate an alarm signal based upon signals from at least one of the sensors.

16. The data logger of claim 13, further comprising:

a higher order rate threshold detector to generate an alarm signal based upon signals from at least one of the sensors.

17. The data logger of claim 13, wherein the sensors are strain gauges.

18. A system for acquiring data relating to the strain of a rock mass in an underground mine, the system comprising:

a plurality of strain gauges;

a support device for the strain gauges adapted to be inserted into a rock mass, the strain gauges being mounted to the support device;

a data logger operable to receive signals from the strain gauges and record the signals in a memory as strain data; and a graphic user interface program for setting one or more operating parameters of the data logger.

19. The system of claim 18, wherein the support device comprises a rock bolt and the data logger is disposed in the rock bolt.

20. The system of claim 18, wherein the graphic user interface program is operable to download the strain data from the data logger to a computer.

21. The system of claim 18, wherein the graphic user interface program is operable to automatically establish a communication link between the data logger and a computer.

22. The system of claim 18, wherein the graphic user interface program has a graphical user interface element operable to cause the data logger to begin sampling the strain gauges.

23. The system of claim 18, wherein the graphic user interface program has a plurality of graphical user interlace elements for setting a plurality of operating parameters of the data logger.

24. The system of claim 23, wherein one of the plurality of graphical user interlace elements allows for user selection of one or more of the plurality of strain gauges to be sampled by the data logger.

25. The system of claim 23, wherein one of the plurality of graphical user interface elements allows for user selection of the scan rate of the data logger.

26. The system of claim 23, wherein one of the plurality of graphical user interface elements allows for user selection of the excitation time of the strain gauges.

27. The system of claim 18, further comprising an alerting device for warning personnel if the measured strain exceeds a predetermined threshold, and wherein the graphic user interface program has a graphical user interface element that allow a user to set the predetermined threshold.

28. The system of claim 27, wherein the alerting device is mounted on the data logger.

29. The system of claim 18, wherein the graphic user interface program includes the alerting device.

30. A system for acquiring data relating to the strain of rock mass in an underground mine, the system comprising:

at least one strain gauge;

a support device for the at least one strain gauge adapted to be inserted into a rock mass, the at least one strain gauge being mounted to the support device;

a data logger operable to receive signals from the at least one strain gauge and record the signals in a memory as strain data; and a graphic user interface program for setting one or more operating parameters of the data logger;

wherein the data logger has a first light source for emitting light of a first color to indicate that strain measured by the strain gauge is within acceptable Limits, a second light source for emitting light of a second color to indicate that strain measured by the strain gauge has exceeded a first predetermined threshold, and a third light source for emitting light of a third color to indicate that strain measured by the strain gauge has exceeded a second predetermined threshold.

31. A method for acquiring strain data relating to the strain of a rock mass in an underground mine, the method comprising:

sampling one or more strain gauges with a data logger and recording multiple strain signals from each strain gauge of the one or more strain gauges in memory of the data logger, the strain signals corresponding to the strain of the rock mass over a period of time;

providing one or more graphical user interface elements for controlling one or more operating parameters of the data logger; and acquiring from user input, via the graphical user interface elements, values for the operating parameters.

32. The method of claim 31, further comprising remotely activating the data logger to begin sampling the one or more strain gauges by a graphical user interface element.

33. The method of claim 31, further comprising graphically displaying strain measured by the one or more strain gauges.

34. The method of claim 33, wherein displaying strain data comprises displaying a time-varying bar graph indicating the strain measured by each of the one or more strain gauges.

35. A rock bolt comprising:

a hollow body comprising a gap along a length of the hollow body;

at least one strain gauge affixed within the body; and wherein:

the at least one strain gauge comprises a plurality of strain gauges; and a data logger is located within the hollow body of the rock bolt, the data logger comprising:

a controller;

a memory coupled to the controller and to an analog-to-digital converter; and a first multiplexer coupled to the controller, the first multiplexer operable to select, in response to signals from the controller, one of the plurality of strain gauges to couple to an excitation source;

a second multiplexer to couple the selected strain gauge in a feedback loop with a voltage feedback amplifier to the first multiplexer, such that a reference excitation voltage to the selected strain gauge is maintained; and wherein the strain gauges are coupled via a single conductor to the analog-to-digital converter.

36. The rock bolt of claim 35, wherein the data logger further comprises a threshold detector to generate an alarm signal based upon signals from at least one of the strain gauges.

37. The rock bolt of claim 35, wherein the data logger further comprises a rate threshold detector to generate an alarm signal based upon signals from at least one of the strain gauges.

38. The data logger of claim 35, wherein the data logger further comprises a higher order rate threshold detector to generate an alarm signal based upon signals from at least one of the strain gauges.

* * * * *

UNITED STATES PATENT AND TRADEMARK OFFICE

CERTIFICATE OF CORRECTION

PATENT NO. : 7,324,007 B2
APPLICATION NO. : 10/499299
DATED : January 29, 2008
INVENTOR(S) : Sunderman et al.

It is certified that error appears in the above-identified patent and that said Letters Patent is hereby corrected as shown below:

Title page Item (56) under Other Publications:

Column 2, line 6, "Fourteenth Years" should be --Fourteen Years--.

In the Specification:

Column 2, line 2, "inserted A visual" should be --inserted. A visual--.

Column 4, line 10, "bolt A plug" should be --bolt. A plug--.

Column 4, line 54, "attachment Although less" should be --attachment. Although less--.

Column 5, line 65, "rock bolt In another" should be --rock bolt. In another--.

Column 12, line 12, "(PIGS. 19-21)" should be --(FIGS. 19-21)--.

In the Claims:

Column 16, line 34, "one of threshold detector," should be --one of a threshold detector--.

Column 16, line 43, "strain gauges in a feedback" should be --strain gauge in a feedback--.

Column 17, line 33, "user interlace elements" should be --user interface elements--.

Column 17, line 37, "user interlace elements" should be --user interface elements--.

Column 18, line 1, "acceptable Limits, a second" should be --acceptable limits, a second--.

Signed and Sealed this

Twentieth Day of April, 2010

David J. Kappos

David J. Kappos
*Director of the United States Patent and Trademark Office*